US005388050A

United States Patent [19]

Inoue et al.

[11] Patent Number: 5,388,050

[45] Date of Patent: Feb. 7, 1995

[54] KNIT DESIGN SYSTEM AND METHOD OF MAKING KNITTING DATA THEREFOR

[75] Inventors: Hitoshi Inoue; Shigeru Takasao, both of Fuji; Makoto Ikeda, Matsudo; Takashi Matsuda; Michiyuki Kitamoto, both of Fuji, all of Japan

[73] Assignee: Asahi Kasei Kogyo Kabushiki Kaisha, Osaka, Japan

[21] Appl. No.: 50,300

[22] PCT Filed: Sep. 16, 1992

[86] PCT No.: PCT/JP92/01182

§ 371 Date: May 14, 1993

§ 102(e) Date: May 14, 1993

[87] PCT Pub. No.: WO93/06285

PCT Pub. Date: Apr. 1, 1993

[30] Foreign Application Priority Data

Sep. 17, 1991 [JP] Japan ..... 3-236469

[51] Int. Cl.[6] ..... G06F 15/46; D04B 7/00

[52] U.S. Cl. ..... 364/470; 66/75.2; 66/232; 364/191

[58] Field of Search ... 364/470, 191, 192, DIG. 2 MS File; 66/232, 237, 75.2

[56] References Cited

U.S. PATENT DOCUMENTS

| | | | |
|---|---|---|---|
| 4,311,029 | 1/1982 | Sommer et al. | 66/232 X |
| 4,346,366 | 8/1982 | Kajivra et al. | 364/900 X |
| 4,479,368 | 10/1984 | Gloeckler | 364/470 X |
| 4,527,402 | 7/1985 | Swallow et al. | 364/470 X |
| 4,608,642 | 8/1988 | Shima | 364/470 |
| 4,768,357 | 9/1988 | Ohtake | 66/75.2 |
| 4,856,104 | 8/1989 | Stoll et al. | 364/470 |

FOREIGN PATENT DOCUMENTS

| | | |
|---|---|---|
| 0235987 | 9/1987 | European Pat. Off. . |
| 0356540 | 3/1990 | European Pat. Off. . |
| 2603619 | 9/1987 | France . |
| 57-29647 | 2/1982 | Japan . |
| 60-71748 | 4/1985 | Japan . |
| 62-33339 | 7/1987 | Japan . |

*Primary Examiner*—Joseph Ruggiero

*Attorney, Agent, or Firm*—Finnegan, Henderson Farabow, Garrett & Dunner

[57] ABSTRACT

An operator inputs design information including shape information and stitch structure information of a fabric to be knitted by a keyboard input unit and a coordinate input unit. An engineering workstation prepares a fabric image showing the state of a finished fabric on the basis of these information, displays it on a color display, and converts it to sequence data indicating the knitting operation sequence of the fabric (knitting machine) and control data indicating the control operation of the knitting machine, respectively.

9 Claims, 27 Drawing Sheets

| POSI-TION | WALE | COURSE | dME | dCOURSE |
|---|---|---|---|---|
| ① | 0 | 20 | 0 | 0 |
| ② | 2 | 16 | 1 | 8 |
| ③ | 9 | 80 | 1 | 10 |
| ④ | 0 | 34 | 0 | 0 |
| ⑤ | 8 | 20 | 2 | 5 |
| ⑥ | 8 | 18 | 2 | 6 |
| ⑦ | 0 | 82 | 0 | 0 |
| ⑧ | 138 | 0 | 0 | 0 |

FIG. 6

| | | HEAD | RESTRIC-TION | TWIST | ENCOUN-TER | STITCH LENGTH | YARN NUMBER | LINK LEFT (DIREC-TION) | LINK LEFT (DIS-TANCE | LINK LEFT (BED) | LINK RIGHT (DIREC-TION) |
|---|---|---|---|---|---|---|---|---|---|---|---|
| NAME | nslots | head | kousoku | nejiri | deai | domoku | yarnNO | yarnLS | yarnLP | yarnLB | yarnRS |
| KNIT | | 1 | 1 | 0 | | | LEFT 0 | | | LEFT | 0 |
| KNIT + TWIST | | 1 | 1 | 1 | | | RIGHT 1 | | | RIGHT | 1 |
| TUCK | | 1 | 0 | 0 | | | | | 0 215 | | |
| TUCK + TWIST | | 1 | 0 | 1 | | | | | | | |
| WELT | | 0 | 0 | 0 | | | | | | FRONT 0 | |
| RETURN | | 0 | 0 | 1 | | | | | | BACK 1 | |
| | | | | | 1 | | | | | | |
| | | | | | 0 | | | | | | |
| RIB ENCOUNTER | | | | WELT | | 0 | | | | | |
| CONFRONTATION ENCOUNTER | | | | SETTING | | 1 ~ 80 | | | | | |
| | | | | | | 101~150 | | | | | |
| | | KNIT TESTING | | | | | | | | | |
| | | | | | BLANK | | 0 | | | | |
| | | | | | OTHERS | | 1 ~ 15 | | | | |

FIG. 23

| | LINK RIGHT (DIS-TANCE) | LINK RIGHT (BED) | HEAD (MOVING DIRECTION OF RIGHT/LEFT) | HEAD (MOVING AMOUNT) | HEAD (MOVING DIRECTION FRONT/BACK) | OVER-LAPPED PAGE | | |
|---|---|---|---|---|---|---|---|---|
| NAME | yarnRP | yarnRB | headS | headP | headB | kasanari | | |
| | | | LEFT 0 | | | | | |
| | | | RIGHT 1 | | EXPLAINED IN THE TEXT | | | |
| | 0 215 | | | 1 ~ 7 | | | | |
| | | | | | | | | |
| | FRONT 0 | | | FRONT 0 | | | | |
| | BACK 1 | | | BACK 1 | | | | |
| | | | | | | | | |
| NORMAL HEAD (TO NEEDLE DIRECTLY OVER) | | | | | | | | |
| | | | 1 | 0 | 0 or 1 | | | |
| DROP | | | 0 | 0 | 0 | | | |

FIG. 24

KNIT DESIGN SYSTEM AND METHOD OF MAKING KNITTING DATA THEREFOR

TECHNICAL FIELD

The present invention relates to a knit design system and method of preparing knitting data thereof, wherein control data for instructing a knitting machine is created, and the state of a finished fabric can be learned by a display.

BACKGROUND ART

Heretofore, when a desired fabric is to be knitted by a knitting machine which is disclosed in U.S. Pat. Nos. 4,608,642 or 4,768,357, for example, an operator must set control data instructing contents for driving a knitting machine mechanism such as knitting needles to be used, moving directions and distances of the needles, and the like, as knitting information.

However, in the knitting machine taught by U.S. Pat. No. 4,768,357, test knitting must be carried out by the machine to determine whether or not the set control data is correct or the desired knit state is achieved. For this reason, test knitting and correction of the set control data must be conducted a plurality of times before entering into mass-production. Thus, tedious work is required to set the final control data for the knitting machine.

A recording device of pattern information described in U.S. Pat. No. 4,608,642 displays stitches on a display screen, wherein the information instructing the knitting operation is inputted in the form of color codes. After that, the recording device prepares control procedure data for the knitting machine according to the color codes inputted. The recording device in U.S. Pat. No. 4,608,642, however, poses a problem in that it requires greater operator skill for setting the control data as the stitch structure becomes complicated.

DISCLOSURE OF THE INVENTION

A first object of the present invention is to provide a knit design system which can reduce the repetition frequency of the test knitting, and enables the operator to learn the state of a finished fabric before actually knitting on the machine.

A second object of the present invention is to provide a knit design system and method for preparing knitting data for the same, which can readily prepare control data to be set to the knitting machine.

According to a first aspect of the present invention, there is provided a knit design system comprising: input means for inputting design information that indicates a shape of a fabric to be knitted and a stitch structure; first storage means for storing first calculation information indicating correspondence between the design information and operation information indicating a content of a knitting operation of a knitting machine; and first calculation processing means for converting the design information inputted from the input means to the operation information on the basis of the first calculation information in the first storage means.

According to a second aspect of the present invention there is provided a knit design system comprising in addition to the first aspect of the present invention: second storage means for storing for each type of knitting machines second calculation information indicating a correspondence between the operation information and control information for driving the knitting machine; designation means for designating a type of the knitting machine; and second calculation means for converting operation information which has been converted by the first calculation means into the control information corresponding to the designated machine type on the basis of the second calculation information in the second storage means corresponding to the designated machine type.

According to a third aspect of the present invention there is provided a knit design system comprising: retaining means for storing and retaining the design information inputted, the operation information prepared, and the control information prepared, in the second aspect of the present invention; and correction means for correcting information stored in the retaining means, wherein the correction means can serve the information corrected to the first calculation means when the information corrected is the design information, and can serve the information corrected to the second calculation means when the information corrected is the operation information.

According to a fourth aspect of the present invention, there is provided a knit design system comprising: third storage means for storing image information indicating a stitch structure in a plurality of graphic patterns; input means for inputting design information indicating a shape of a fabric to be knitted and a stitch structure; first image processing means for forming a contour image corresponding to a shape indicated by the design information inputted; second image processing means for preparing a stitch image by using the plurality of graphic patterns corresponding to a structure indicated by the design information inputted from the input means; third image processing means for synthesizing the stitch image prepared and the contour image in order to prepare a fabric image; and display means for displaying the fabric image prepared.

According to a fifth aspect of the present invention, there is provided a knit design system, wherein the second image processing means in the fourth aspect of the present invention selects the graphic patterns externally instructed, and displays on the display means a fabric image by using only graphic patterns selected.

According to a sixth aspect of the present invention, there is provided a knit design system, wherein the third image processing means in the fourth aspect of the present invention scales up or down the fabric image prepared.

According to a seventh aspect of the present invention, there is provided a knit design system, wherein the third image processing means in the fourth aspect of the present invention prepares the stitch image for front portion and back portion of the fabric, respectively.

According to an eighth aspect of the present invention, there is provided a knitting data preparation method comprising the steps of: predetermining a first correspondence between a plurality of first characteristic parameters indicating a stitch structure and a plurality of second characteristic parameters indicating a knitting operation of stitches; storing expansively on a memory the plurality of first characteristic parameters associated with a fabric in a manner that each of the plurality of first characteristic parameters corresponds to each one of positions of stitches constituting the fabric to be knitted; reading by using a searching processing of a calculation unit the plurality of first characteristic parameters successively along a knitting direction of a yarn, the reading being performed with regard to positions of stitches continuously formed by the same yarn in the fabric; and preparing knitting data indicating a knitting procedure of the fabric by converting the plurality of first characteristic parameters which have been read to the plurality of second characteristic parameters according to the first correspondence by using a calculation processing of the calculation unit.

According to a ninth aspect of the present invention, there is provided a knitting data preparation method comprising, in addition to the steps of the eighth aspect, the steps of: predetermining a second correspondence between a plurality of control parameters designating a knitting operation of a knitting machine and the plurality of second parameters; rearranging the plurality of second characteristic parameters in a knitting sequence of the knitting machine by the calculation unit; and converting by the calculation processing of the calculation unit the plurality of second characteristic parameters which have been rearranged to the plurality of control parameters according to the second correspondence, so that second knitting data for controlling the knitting machine is prepared.

According to the tenth aspect of the present invention, there is provided a computer program product for use with a knit design system, having a computer usable medium including computer readable program code means embodied in the medium for causing the computer to convert first characteristic parameters indicating a structure of a stitch to second characteristic parameters indicating a knitting operation of the stitch, the computer program product comprising: first computer readable program code means for causing the computer to define a correspondence between the first characteristic parameters and the second characteristic parameters; second computer readable program code means for causing the computer to store expansively on a memory in the computer the plurality of first characteristic parameters associated with a fabric in a manner that each of the plurality of first characteristic parameters corresponds to each position of stitches constituting the fabric to be knitted; third computer readable program code means for causing the computer to read by using a search processing of the computer the plurality of first characteristic parameters from the memory along a knitting direction of a yarn in a manner that each of the plurality of first characteristic parameters to be read corresponds to each of positions of stitches that are continuously formed by the same yarn in the fabric; and fourth computer readable program code means for causing the computer to prepare knitting data indicating a knitting procedure of the fabric by converting by a calculation processing of the computer the plurality of first characteristic parameters which have been read to the plurality of second characteristic parameters according to the first correspondence.

According to an eleventh aspect of the present invention, there is provide a computer program product comprising in addition to the tenth aspect of the present invention: fifth computer readable program code means for causing the computer to define a second correspondence between a plurality of control parameters designating a knitting operation of a knitting machine and the plurality of second characteristic parameters; sixth computer readable program code means for causing the computer to rearrange the second characteristic parameters to a knitting sequence of the knitting machine; and seventh computer readable program code means for causing the computer to convert the plurality of second characteristic parameters which have been rearranged to the plurality of control parameters according to the second correspondence.

According to the first aspect of the present invention, the operation information indicating the knitting operation of knitting needles and the like is prepared from the design information such as a stitch length, a type of stitches and the like.

According to the second aspect of the present invention, the control information for operating knitting needles and the like is prepared from the operation information.

According to the third aspect of the present invention, the operator can prepare new control information by correcting the design information and the operation information which are used in preparing the control information.

According to the fourth aspect of the present invention, the operator can observe the state of a finished fabric of the knitting using the design information by merely inputting the design information of the fabric.

According to the fifth aspect of the present invention, the entire structure of a fabric can be readily learned since particular design information, which indicates various structural details such as a stitch type, a relationship of connection between stitches, and the like, is displayed individually in graphic patterns.

According to the sixth aspect of the present invention, details of a fine structure of stitches are readily seen because of the enlargement of the display. Furthermore, the entire fabric shape is easily seen by the reduction of the display.

According to the seventh aspect of the present invent ion, since the front port ion and the back portion can be displayed, the actual knit state of the entire fabric is well shown.

According to the eighth aspect of the present invention, the structural contents of the entire fabric is stored in the memory by storing the first characteristic parameters in such a manner that they correspond to respective stitches, considering the fact that the structure of a single stitch has one-to-one correspondence with the operation of a knitting needle that knits that stitch structure. A series of the first characteristic parameters arranged in accordance with the sequence of the knitting operation is prepared by extracting, from an information group of the first characteristic parameters stored on the memory, the first characteristic parameters at a position where a stitch such as a loop is formed, along the knitting direction of the yarn. The knitting data, which represent the knitting procedure of the entire fabric such as the sequence of the operation of knitting needles, is prepared by converting each of the series of the first characteristic parameters to the second characteristic parameter.

According to the ninth aspect of the present invention, the control parameters for operating the knitting needles of an actual knitting machine is prepared according to the second characteristic parameters, for instance, the moving sequence of the knitting needles.

According to the tenth aspect of the present invention, the processing steps described in the eighth aspect of the present invention are implemented by a software processing of the computer.

According to the eleventh aspect of the present invention, the processing steps described in the ninth aspect of the present invention are implemented by a software processing of the computer.

BRIEF DESCRIPTION OF THE DRAWINGS

FIG. 6 is a table showing shape data of the embodiment according to the present invention;

FIG. 23 is a schematic diagram showing the contents of the design data, and their stored state in a memory of the embodiment according to the present invention;

FIG. 24 is a schematic diagram showing the contents of the design data, and their stored state in a memory of the embodiment according to the present invention;

BEST MODE FOR CARRYING OUT THE INVENTION

Figure 1:
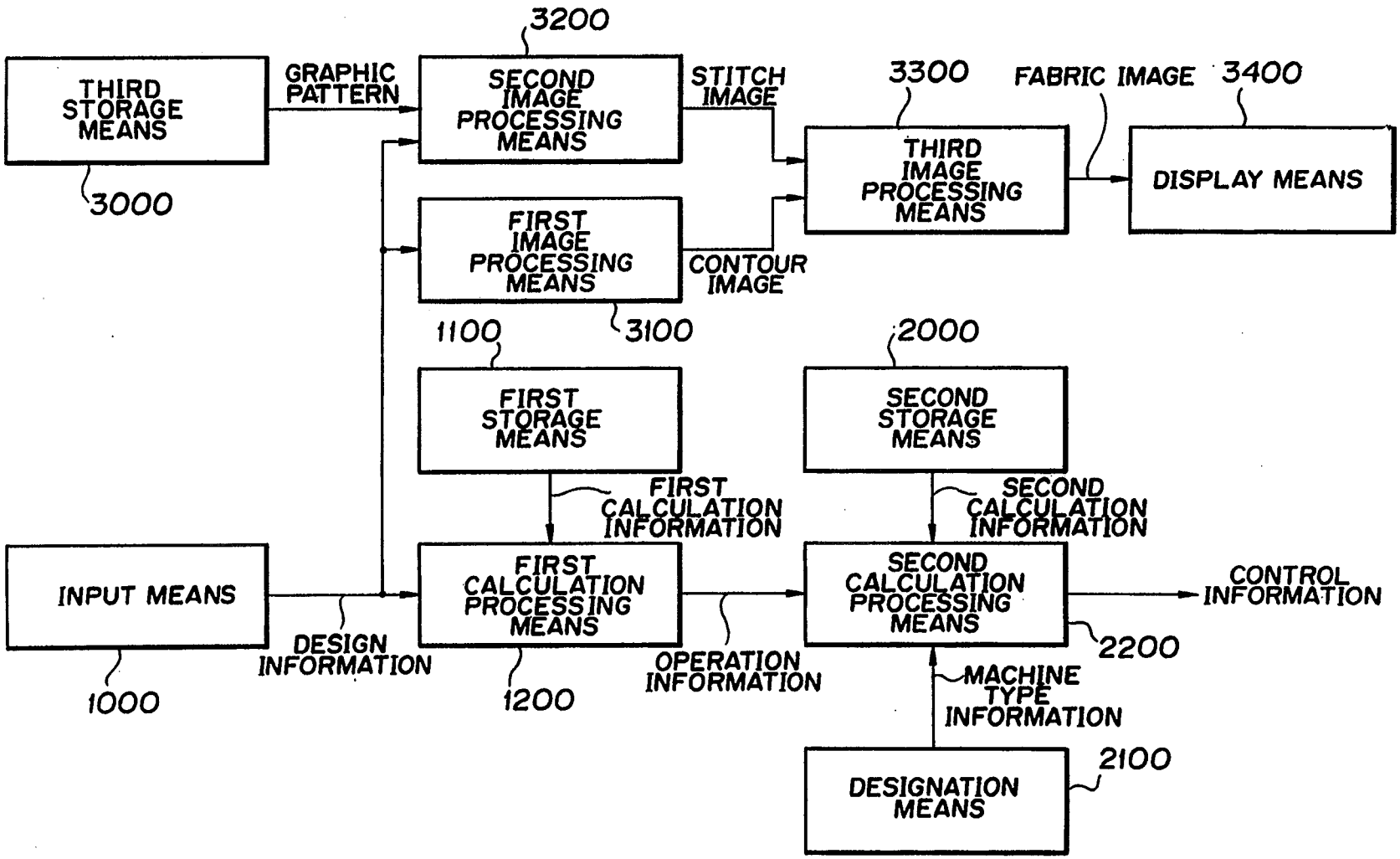
FIG. 1 is a block diagram showing a basic construction of an embodiment according to the present invention.

FIG. 1 shows a basic construction of an embodiment according to the present invention.

In FIG. 1, the numeral 1000 indicates an input means for inputting design information instructing a shape and stitch structure of a fabric to be knitted.

The numeral 1100 indicates a first storage means for storing first calculation information instructing a correspondence relation between the design information and the operation information providing the contents of the knitting operation of a knitting machine.

The numeral 1200 indicates a first calculation means for converting the design information inputted from the input means to the operation information according to the first calculation information of the first storage means.

The numeral 2000 indicates a second storage means for storing, for each type of the knitting machines, second calculation information indicating a correspondence relation between the operation information and the control information for driving the knitting machine.

The numeral 2100 indicates designation means for designating a machine type of the knitting machine.

The numeral 2200 indicates a second calculation means for converting the operation information that has been converted by the first calculation means into the control information corresponding to the designated machine type according to the second calculation information in the second storage means corresponding to the designated machine type.

The numeral 3000 indicates a third storage means for storing image information representing stitch structures in terms of a plurality of graphic patterns.

The numeral 3100 indicates a first image processing means for forming a contour image corresponding to the shape indicated by the design information which has been inputted from the input means.

The numeral 3200 indicates a second image processing means for preparing a stitch image using the plurality of graphic patterns corresponding to the structure indicated by the design information which has been inputted from the input means.

The numeral 3300 indicates a third image processing means for preparing a fabric image by combining the stitch image prepared and the contour image.

The numeral 3400 indicates a display means for displaying the prepared fabric image.

Prior to describing the present invention in more detail, a system construction of a knit design system to which the present invention is applied will be described with reference to FIG. 2.

Figure 2:
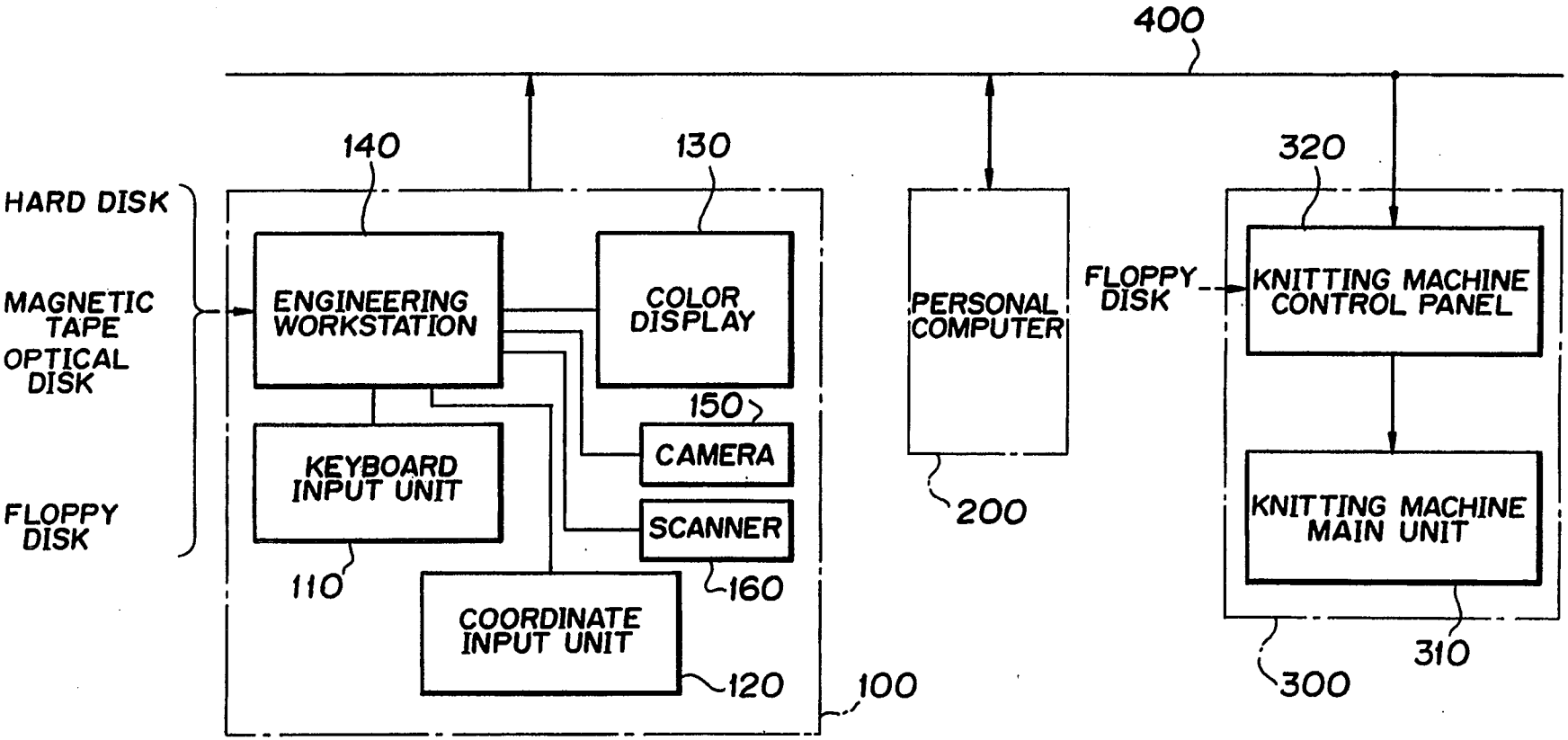
FIG. 2 is a block diagram showing a detailed system construction of the embodiment according to the present invention.

In FIG. 2, a CAD system 100 for conducting the design of fabrics, a personal computer 200 for assisting the system processing, and a knitting machine 300, which are associated with the present invention, are connected in the form of a network through a communication cable 400.

The CAD system 100 mainly comprises a keyboard input unit 110, a coordinate input unit 120 such as a mouse, a color display (display unit) 130, and an engineering workstation 140. The CAD system is detachably provided with an electronic camera 150, a scanner 160, a portable storage medium such as a floppy disk and the like.

The operator uses the keyboard input unit 110 and the coordinate input unit 120 to input various data (design information) on the design of the fabric. The color display 130 (the display unit) displays the input data and the states of the designed fabric. As will be described later, the color display 130 displays, according to the operator's instruction, knitting procedure data (sequence data, the operation information of the first aspect of the present invention) which have been converted from the input data by the engineering workstation 140, or the control data for controlling the drive of the knitting machine 300.

Any type of known image processing unit that can perform image reduction, enlargement and the preparation of a graphic image can be used as the engineering workstation 140.

The camera 150 and the scanner 160 are used for picking up an imaging of a fabric, and inputting the image to the engineering workstation 140, respectively.

The knitting machine comprises a knitting machine main unit 310 and a knitting machine control panel 320. The knitting machine control panel 320 is provided with the drive control data inputted through the communication cable 400 or with the drive control data stored on a portable storage medium such as a floppy disk, and drives the knitting machine main unit according to the driving control data. Since a conventional type knitting machine 300 known in the art, such as that described in U.S. Pat. No. 4,768,357, can be employed as the knitting machine 300, the details thereof are not described herein.

Figure 3:
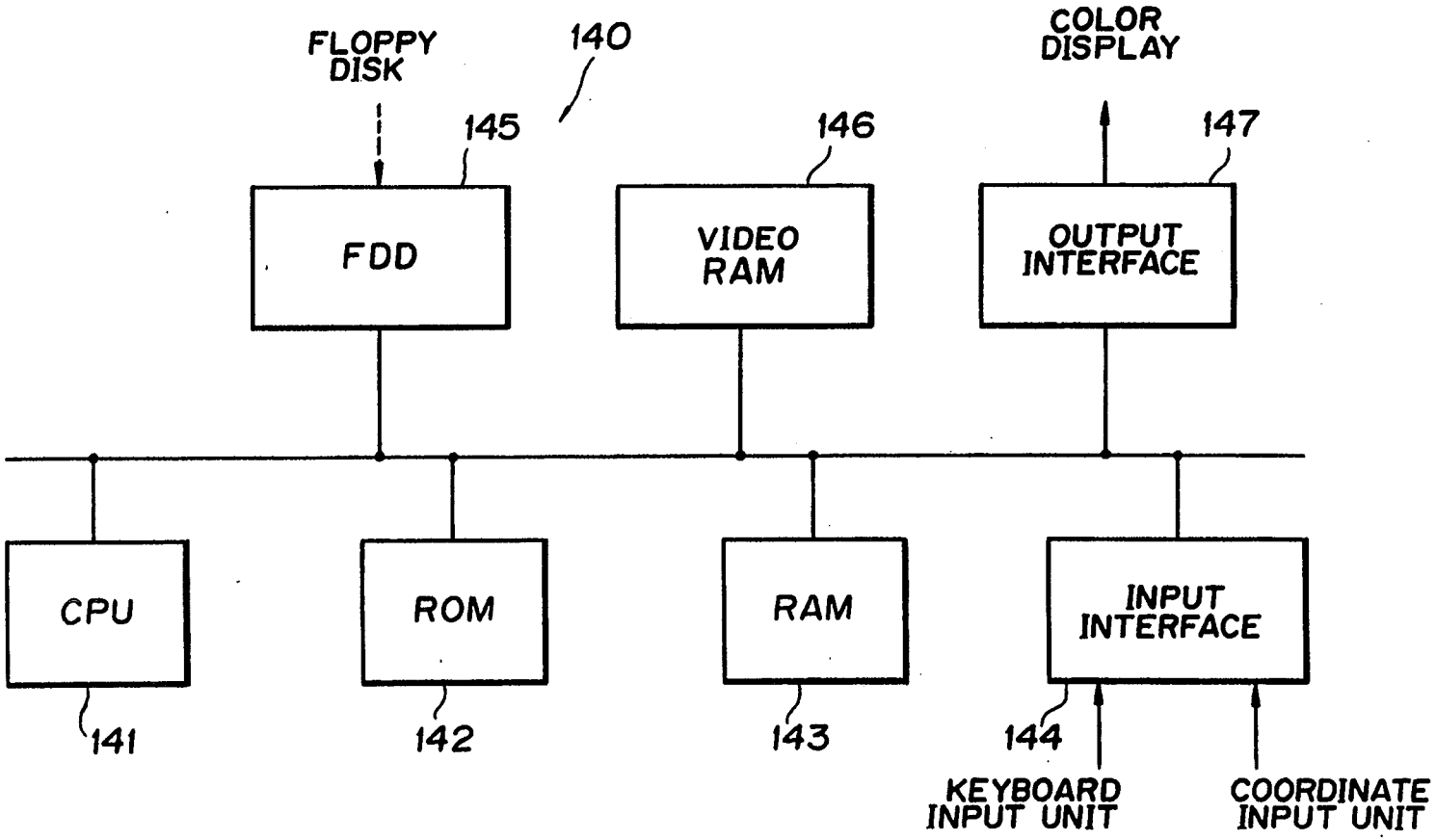
FIG. 3 is a block diagram showing a construction of an engineering workstation shown in FIG. 2.

An example of the construction of the engineering workstation 140 is shown in FIG. 3.

In FIG. 3, a central processing unit (CPU) 141 conducts an information transfer processing with various devices connected via a bus, in accordance with a system program stored in a read only memory (ROM) 142. The CPU 141 also reads programs (first and second calculation information of the first and second aspects of the present invention) for fabric design from the floppy disk set in a floppy disk storage unit (FDD) 145, and loads them on a random access memory (RAM) 143. Furthermore, the CPU 141 executes, according to the programs in the RAM 143, a fabric design processing, a preparation processing of the knitting procedure, and a preparation of the knitting machine control data, which will be described below.

As will be described later, the CPU 141 operates as the first and second calculation means (the first calculation means 1200 and the second calculation means 2200 shown in FIG. 1) of the first and second aspects of the present invention.

A video RAM 146 has an area for storing image information to be displayed on the color display 130 and a synthesizing area for preparing the image information.

The display image information on the video RAM 146 is read by the CPU 141, and is outputted to the color display 130 through an output interface 147.

Information on fabric design, which has been instructed by the operator using the keyboard input unit 110 and the coordinate input unit 120, is transferred to the CPU 141 through an input interface 144. The input interface 144 can also be connected to the camera 150 and the scanner 160.

The keyboard input unit 110 and the coordinate input unit 120 operate as the input means (input means 1000 in FIG. 1) of the first aspect of the present invention, and as the designation means (designation means 2100 in FIG. 1) of the first aspect of the present invention.

With such a system arrangement, the operator prepares the control data indicating the knitting procedure of the fabric and the drive control data for the knitting machine 300 by using the CAD system 100.

Figure 4:
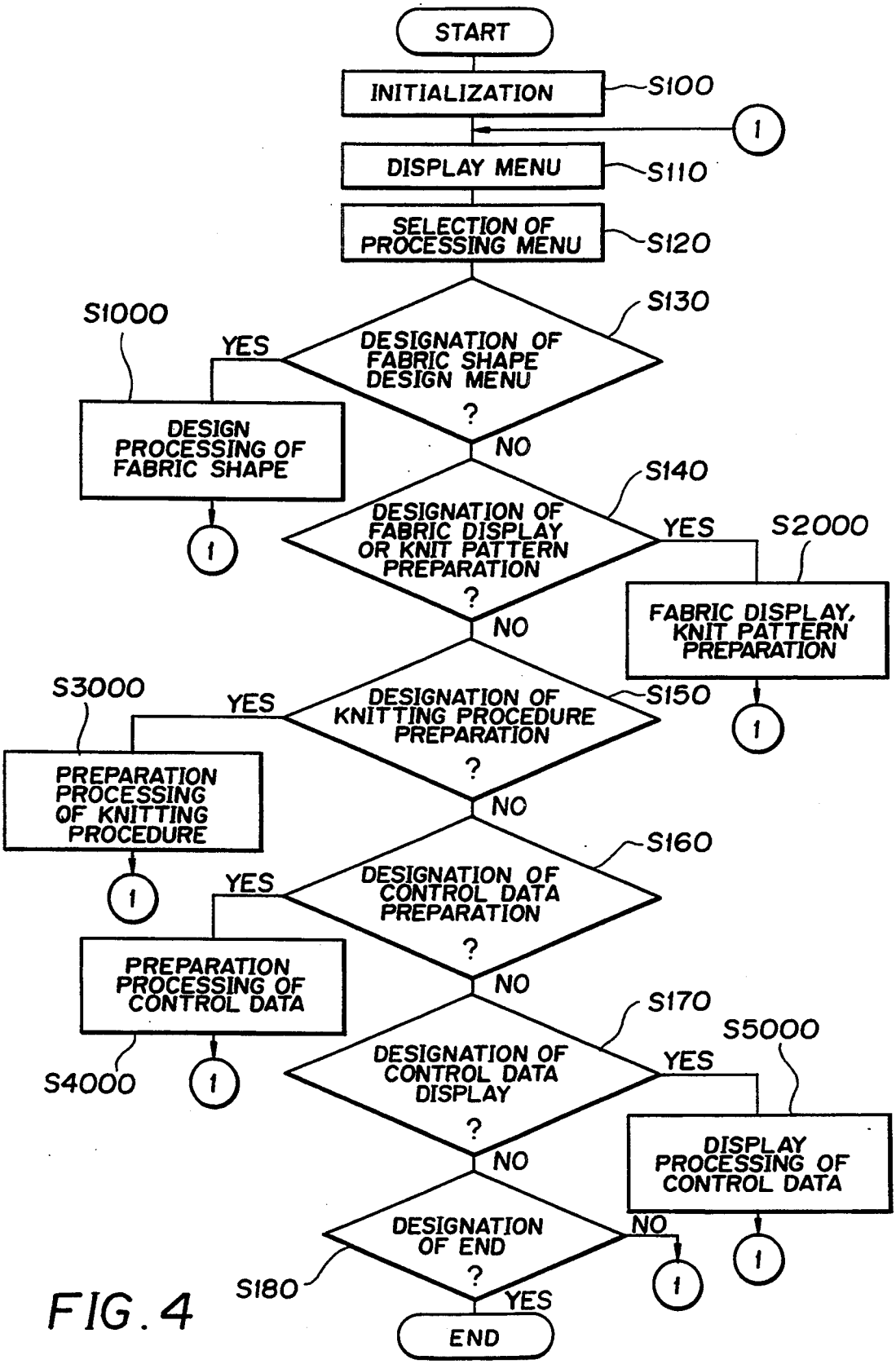
FIG. 4 is a flow chart showing a main control procedure of the system processing in the embodiment of the present invention.

The main control procedure for executing this processing is shown in FIG. 4. This control procedure has been stored in a floppy disk in advance, and is transferred to the program memory in the engineering workstation 140 in response to a start (read) instruction from the keyboard input unit 110 when the floppy disk is set into the engineering work station. The main control procedure shown in FIG. 4 is then executed by the microprocessor or the central processing unit (CPU 141 in FIG. 3) in the engineering workstation 140 in response to a processing instruction from the keyboard input unit 110.

A design processing associated with the present invention will now be described with reference to the flow chart shown in FIG. 4.

The engineering workstation 140 initializes various devices in the machine and various data values necessary for the processing in response to a control procedure start instruction in FIG. 4 (step S100). The menu is then displayed on the color display 130 to prompt the operator to select a processing menu (step S110).

The present embodiment has the following processing menu.

1) Design processing of a fabric shape
2) Fabric display processing for displaying the state of the finished fabric when knitting is carried out by the knitting machine and the knit pattern preparation processing, which are performed on the basis of the data associated with the fabric that has been prepared by the design processing of the fabric shape.
3) Processing for preparing the knitting procedure of the designed fabric (corresponding to the first and third aspects of the present invention).
4) Processing for preparing the drive control data of the knitting machine from the knitting procedure mentioned above (corresponding to the second aspect of the present invention).

5) Processing for displaying the drive control data for the knitting machine.

6) Processing to complete the execution of the control procedure in FIG. 4.

The operator selects a desired processing menu from the above-mentioned menu by designating the menu position by the cursor on the display screen of the color display 130 by means of the coordinate input unit 120 (step S120).

The engineering workstation 140 reads from an internal program memory a sub-processing procedure corresponding to the selected processing menu item (except for end processing), and executes it. When the processing of the selected processing menu item has been completed, the execution procedure of the engineering workstation 140 returns to step S110, where the menu is displayed, and the operator selects another menu processing item.

Each item of the processing menu mentioned above will be described in order of the operator's operation procedure.

(A) Design Processing of a Fabric Shape

Figure 5:
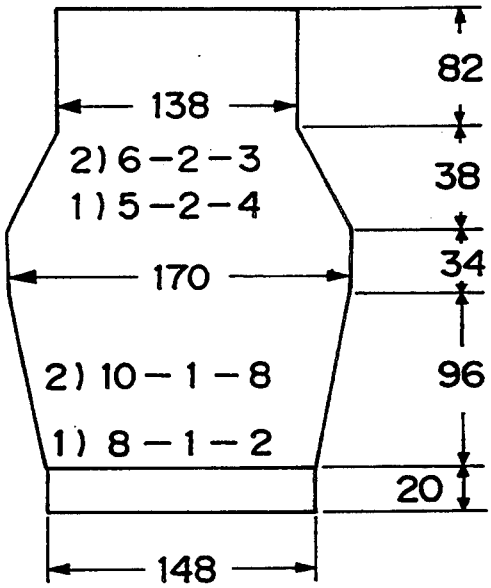
FIG. 5 is a schematic diagram showing shape data of the embodiment according to the present invention.

Suppose that a fabric example as shown in FIG. 5 is to be designed. In FIG. 5, numerals that are placed between arrows in the vertical or horizontal direction indicate the number of stitches. Numerals including "—" symbols like 6—2—3 indicate that a step is repeated three times, in which the number of stitches is decreased (or increased) by two stitches when 6 courses are knitted.

The dimensions of the fabric are assumed to take values as shown in FIG. 6. In FIG. 6, the position numbers are an identification number affixed to the position designated by a shape input processing which will be described later.

Figure 7:
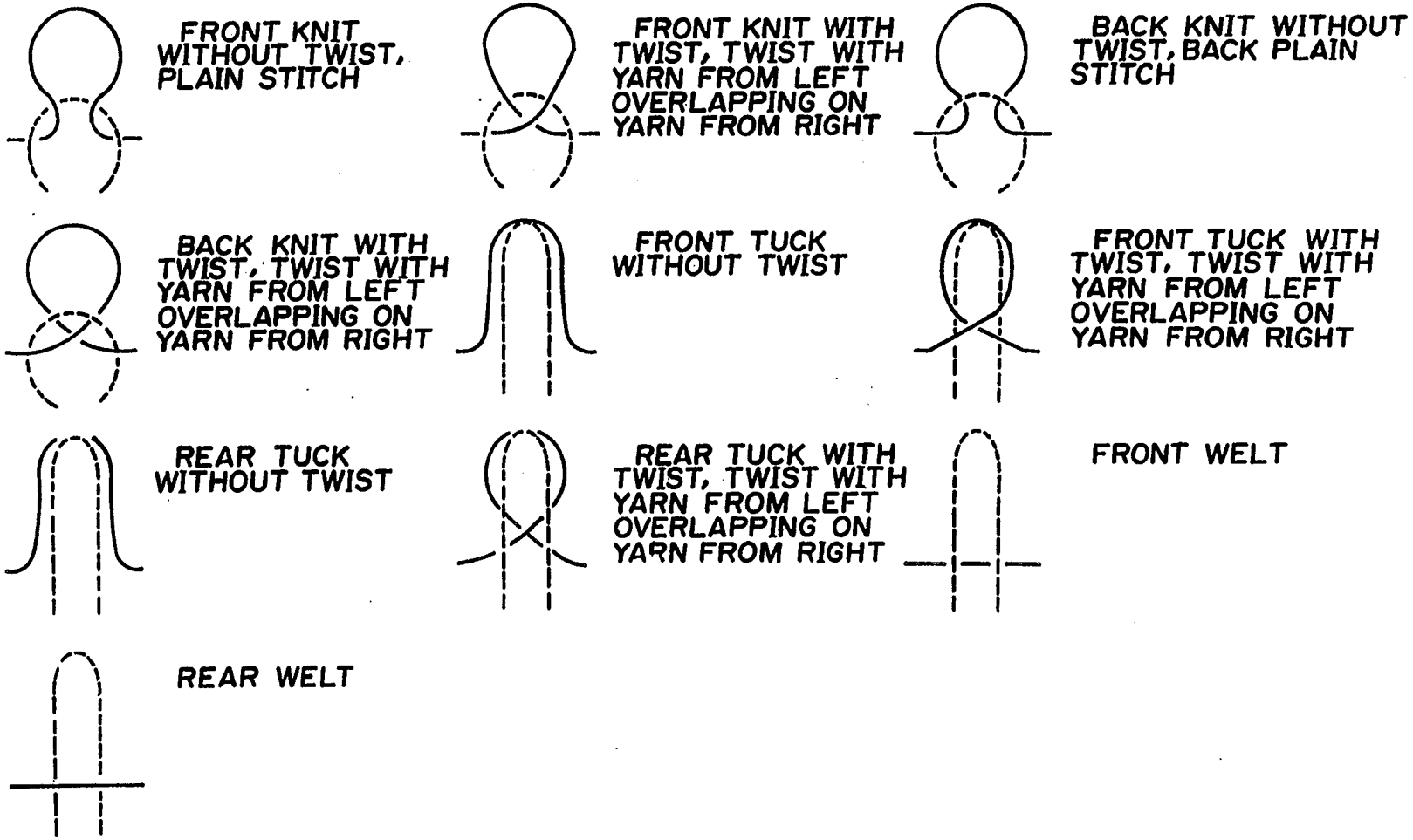
FIG. 7 is a schematic diagram showing loop shapes, stitch structures, and knitting manners which can be handled in embodiments in accordance with the present invention.

Furthermore, various types of stitch structures shown in FIG. 7 can be handled by the present embodiment.

Figure 8:
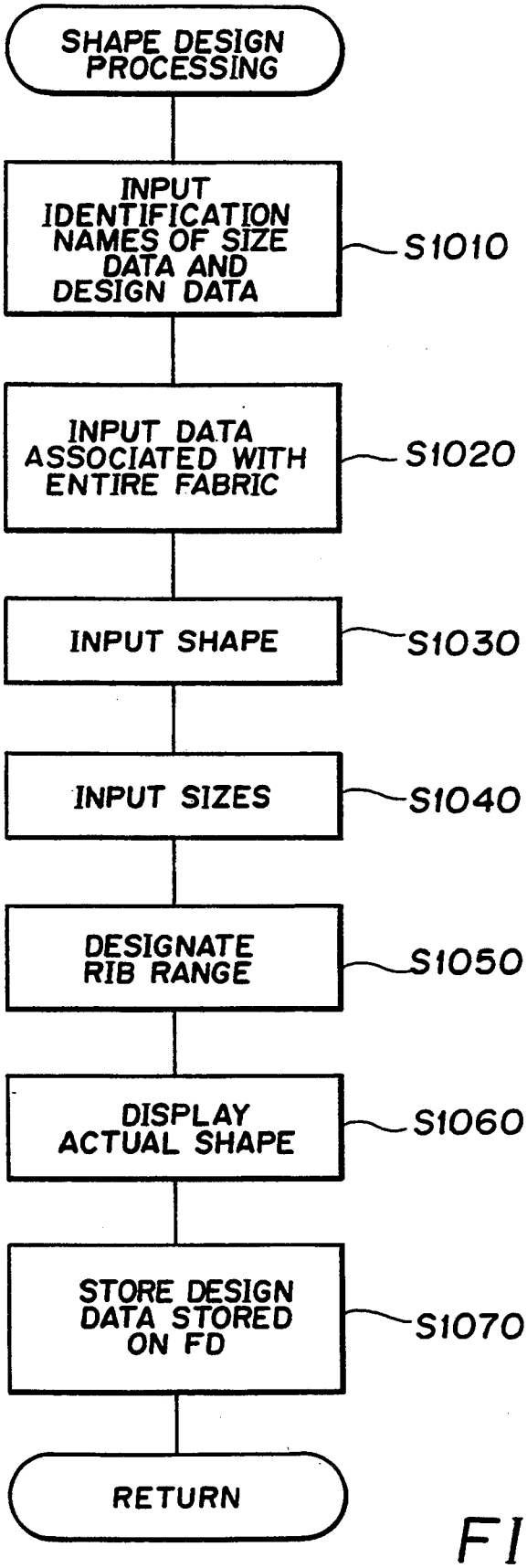
FIG. 8 is a flow chart showing a control procedure for a shape design processing of the embodiment according to the present invention.
Figure 9:
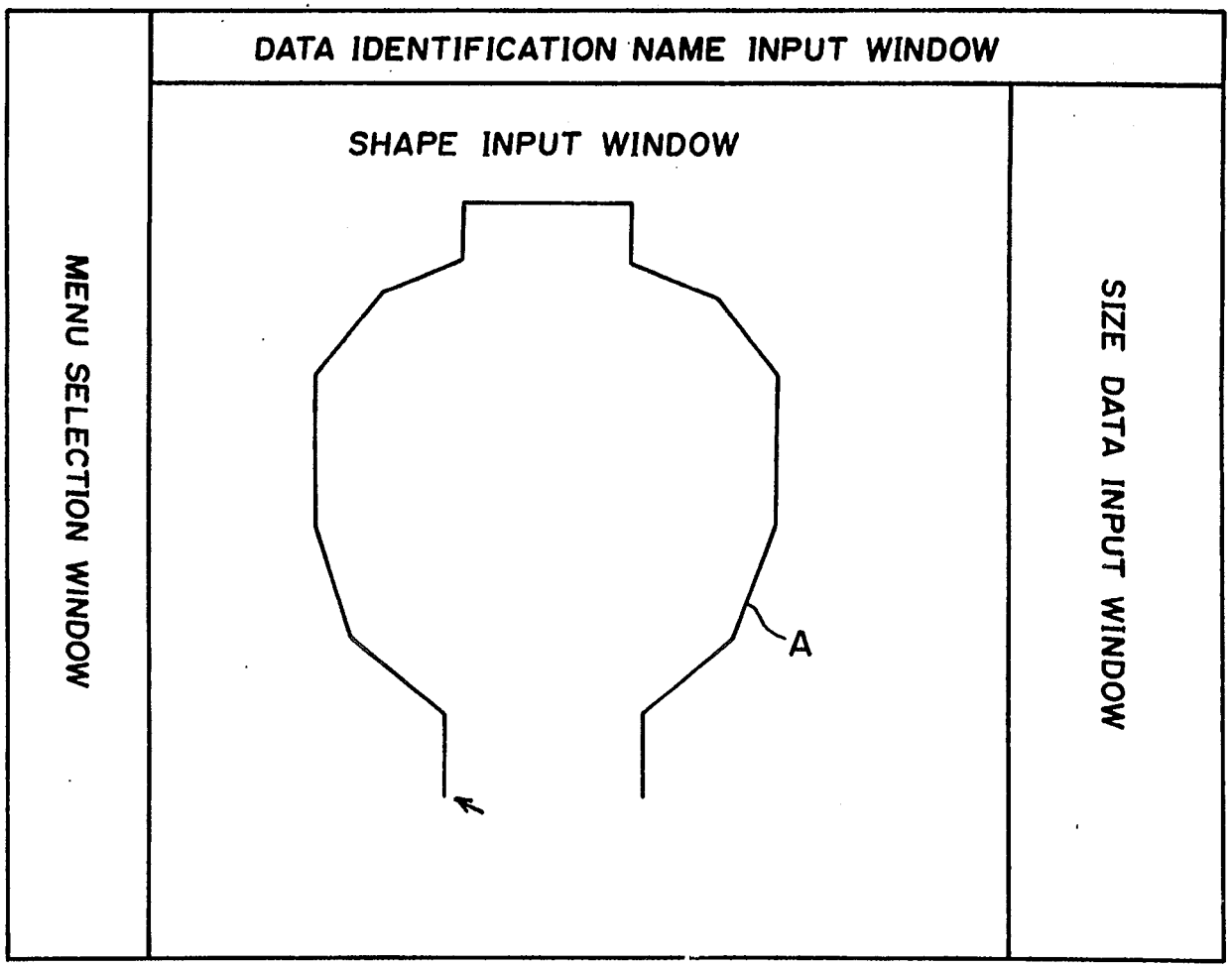
FIG. 9 is a schematic diagram for explaining an input operation of fabric shape information of the embodiment according to the present invention.

By selecting the design processing menu of a fabric shape, the engineering workstation 140 transfers its processing to the control procedure of FIG. 8, and displays an image as shown in FIG. 9 on the color display 130. At this point, the contour image A of the shape input window for inputting the shape information is not displayed.

The operator moves the cursor onto the size button (not shown) in the window for menu selection shown in FIG. 9 by the coordinate input unit 120, and sets the mode for inputting the size data and the stitch structure. Then, the operator enters identification names of the data to be inputted henceforth from the keyboard input unit 110 (step S1010).

Next, the operator inputs data with regard to the entire fabric from the keyboard input unit 110 (step S1020). The input data includes:

A unit of a size input;

Stitch length of the entire fabric;

Parameter values indicating the knitting manner of one stitch (see FIGS. 23 and 24, details thereof which will be described later); and A yarn number used for knitting, a link start position, and an end position.

The engineering workstation 140 stores the input data into the internal memory every time the input data is entered from the keyboard input unit 110.

For this purpose, the operator moves the cursor along the contour in FIG. 9 on the display screen of the color display 130 by using the coordinate input unit 120 so that the contour image is displayed on the display screen, and the shape is inputted (step S1030). The inputted shape is stored in the engineering workstation 140 in the form of a two-dimensional dot pattern.

Next, the operator sets the size input mode by pointing with the cursor a size input switch (function) in a size data input window on the display screen, and then inputs the fabric sizes (FIG. 6) at various locations of the contour pattern A on the display screen, as well as common input data and their positions by using the coordinate input unit 120 and the keyboard input unit 110 (step S1040). The common input data includes, for example, structural data of one stitch (which will be described later), a type of narrowing, the number of stitches of the narrowing, the stitch length of the narrowing, a linking type, and linking stitch length.

Figure 11:
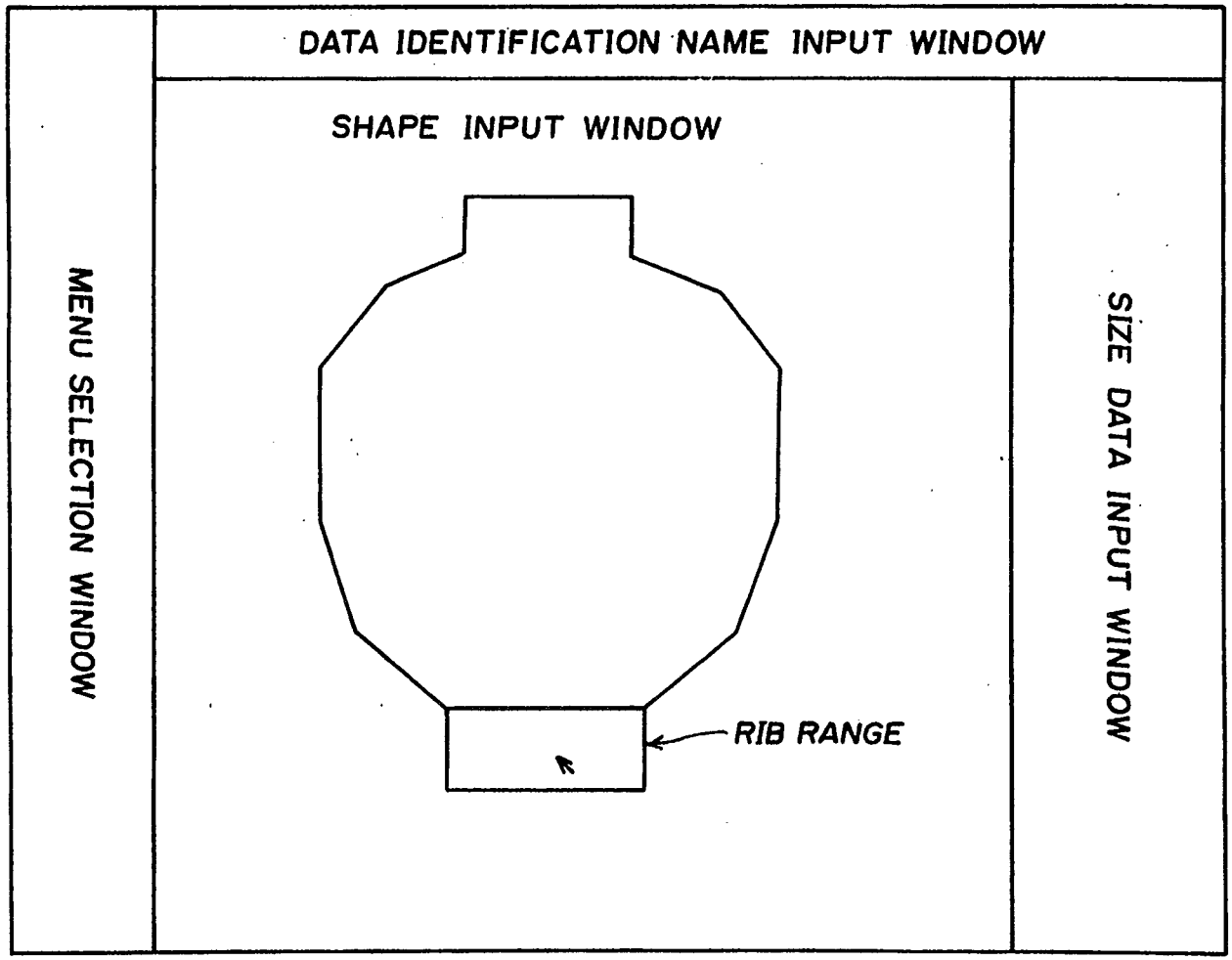
FIG. 11 is a schematic diagram for explaining an input operation of knitting manner information of the embodiment according to the present invention.

Then, the operator sets the input mode for a bottom rib stitch, inputs the range of the rib stitch (called a "rib range") as shown in FIG. 11 by the coordinate input unit 120, and designates a type of the rib stitch (e.g. a type of the rib, a stitch length of the rib) by an indication switch in the size data input window (step S1050).

The input data described above are stored in exclusive storage area in the memory of the engineering workstation 140 as follows. The shape data is stored in the form of dot patterns or in terms of end point position data. The other input data is stored in the form of numerical values or identification symbols.

The common data relating to the stitches is stored expansively in the memory for individual stitch positions in the fabric.

Figure 12:
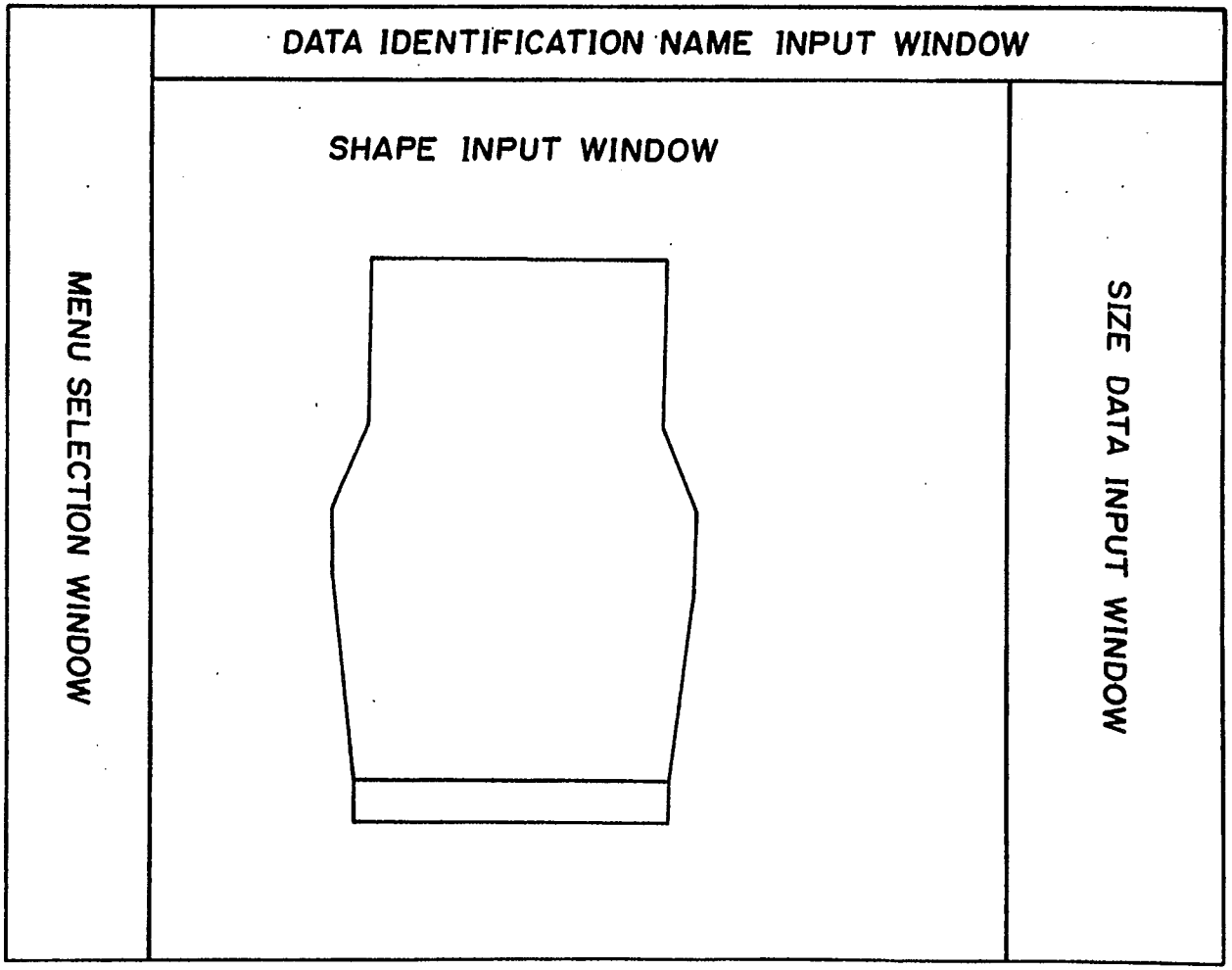
FIG. 12 is a schematic diagram illustrating an example of a fabric shape display of the embodiment according to the present invention.

When the operator operates the displayed switch in the size data input window, the CPU (whose numerical reference is 141; hereinafter the reference is omitted) in the engineering workstation 140 reads size data in the memory, creates in the memory (RAM 143) a contour image showing the actual shape in proportion to the sizes, and displays it in the shape input window of the color display 130 as shown in FIG. 12 (step S1060).

Subsequently, according to the operator's instruction, the CPU in the engineering workstation 140 stores the input design data (size data, stitch-related data) on a floppy disk (FD) (step S1070). After that, the CPU of the engineering workstation 140 completes the control procedure in FIG. 8, returns to the menu display processing of step S110 in FIG. 4, and waits for the operator's selection of another menu item.

(B) A Knit Pattern Design and a Display Processing of the Fabric

Figure 13:
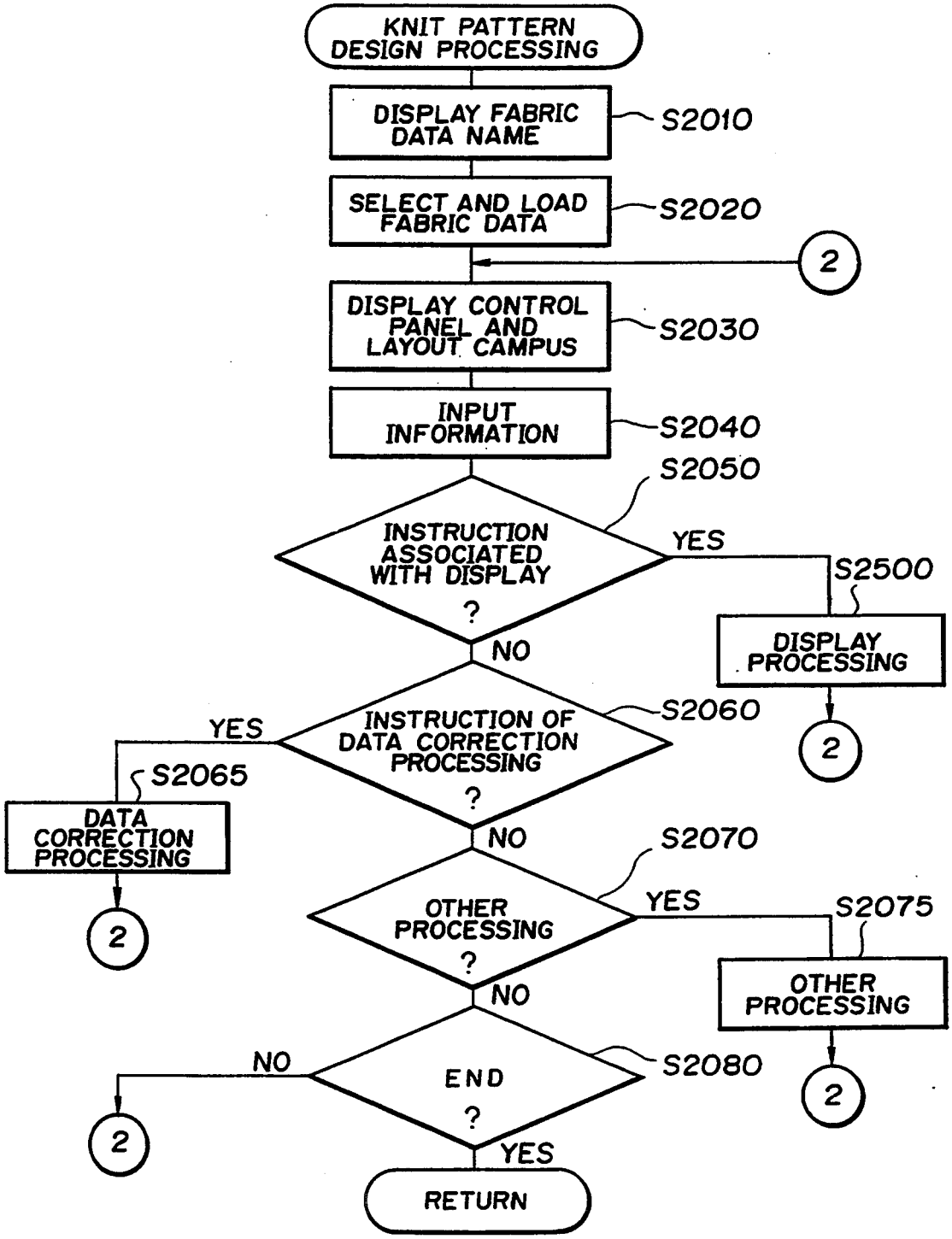
FIG. 13 is a flow chart showing a knit pattern design procedure of the embodiment according to the present invention.

When the operator selects the knit pattern design and fabric display menu from the initial menu screen (which is displayed in step S110 of FIG. 2), the control procedure of FIG. 13 is executed by the engineering workstation 140. The identification name of the fabric data that has been prepared in the above fabric design processing and stored on the floppy disk, is read by the engineering workstation 140, and is displayed on the color display 130 (step S2010).

The operator specifies a desired data name with the cursor moved by the coordinate input unit 120. The engineering workstation 140 reads the fabric data corresponding to the specified fabric data name (design data name) from the floppy disk, and loads (stores) it in the internal memory (step S2020).

The engineering workstation 140 then divides the display screen of the color display 130 into three window area, that is, a fabric canvas area, an operation panel area, and a layout canvas area, and displays the following patterns and images in the individual areas. The fabric canvas area displays an enlarged fabric image of a specified part of the contour image showing the fabric shape displayed in the layout canvas area.

The layout canvas area displays in a reduced form the shape data (FIG. 12) included in the selected fabric data. The operation panel window displays not only various switches that are used for the data input in the knit pattern design, but also switch groups for inputting instructions associated with the display, such as enlargement, reduction, movement, and the like of the fabric canvas area.

Figure 14:
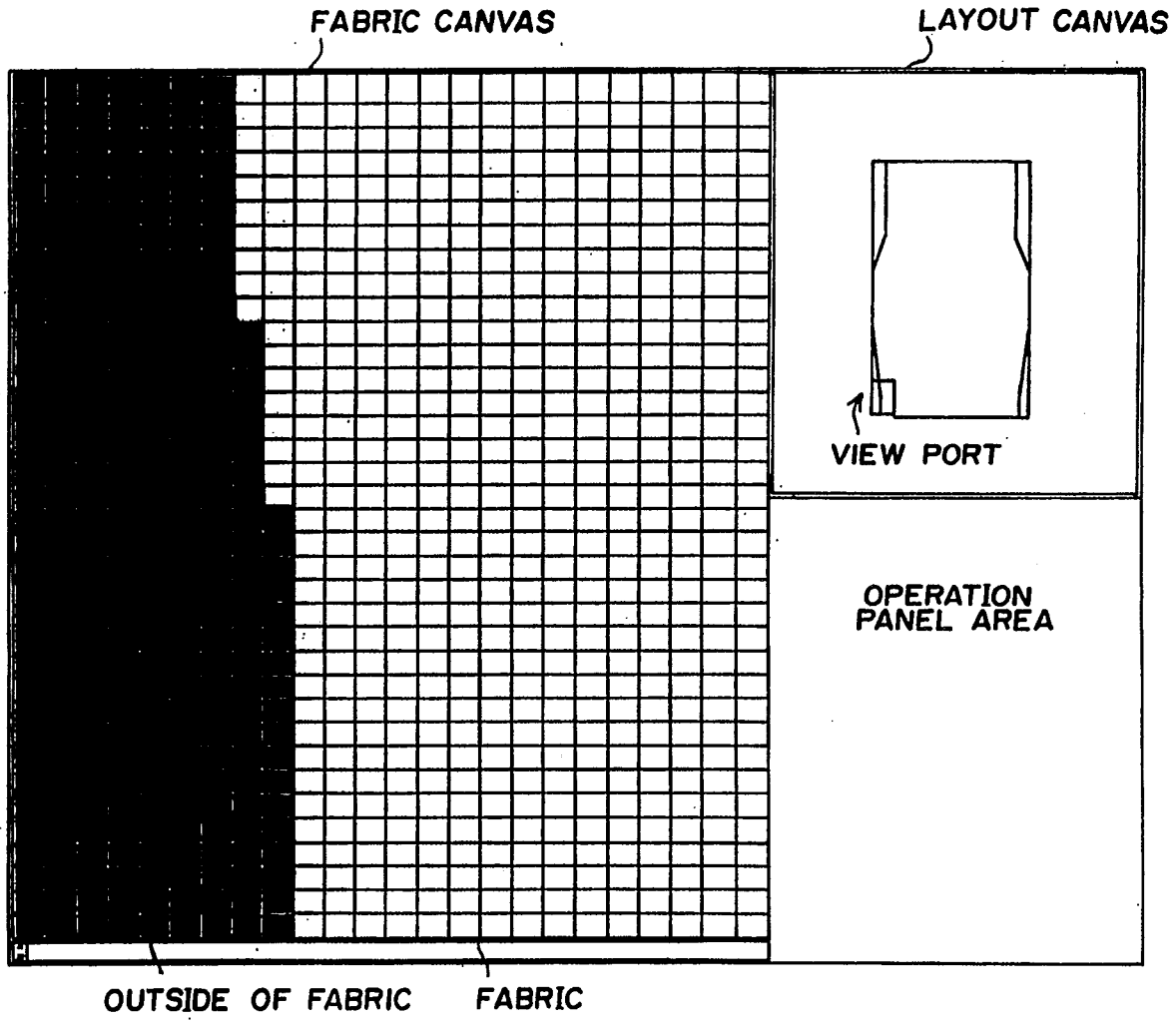
FIG. 14 is a schematic diagram showing an example of a display in the knit pattern design processing of the embodiment according to the present invention.
Figure 15:
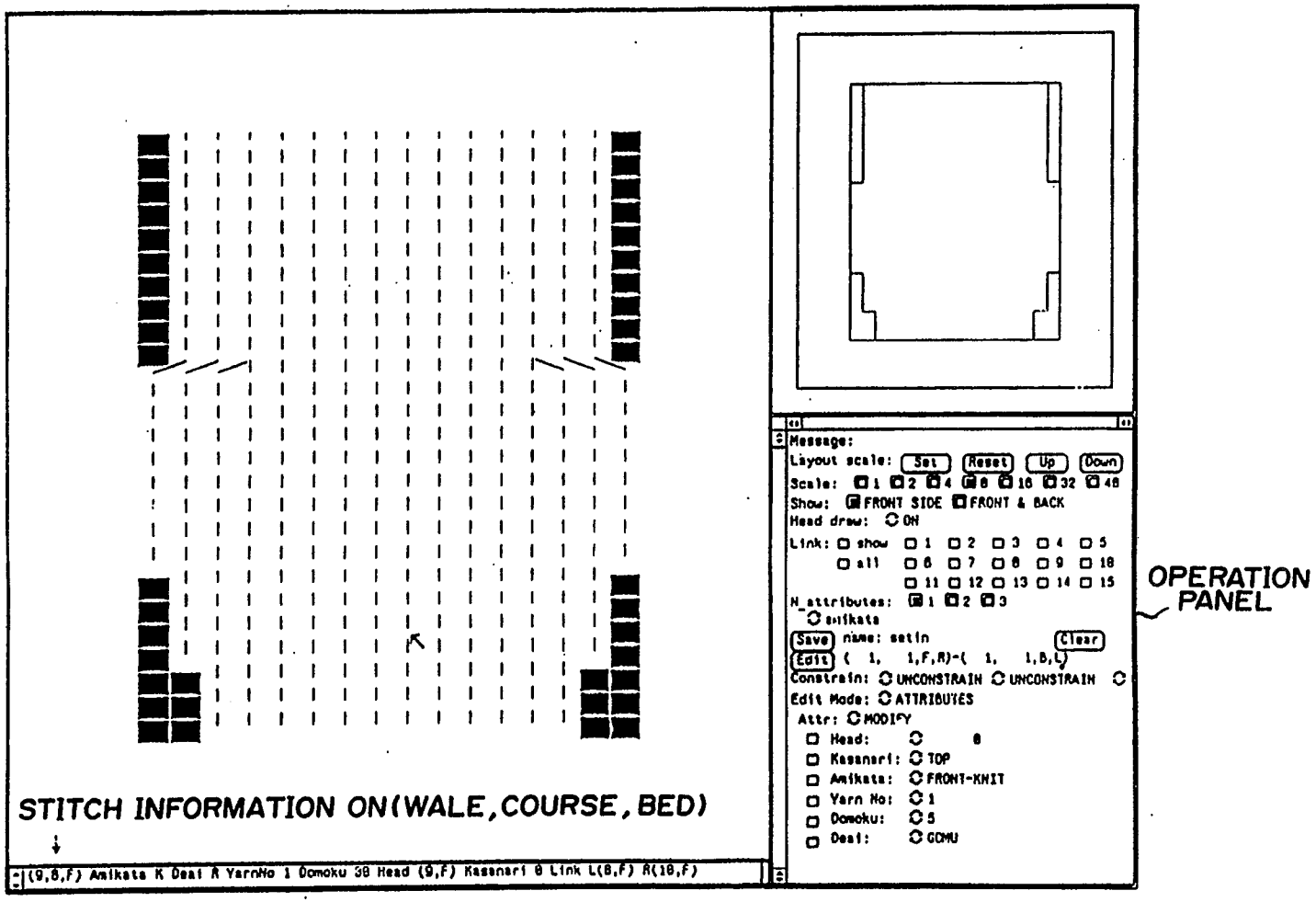
FIG. 15 is a schematic diagram showing an example of a stitch information display in the knit pattern design processing of the embodiment according to the present invention.
Figure 18:
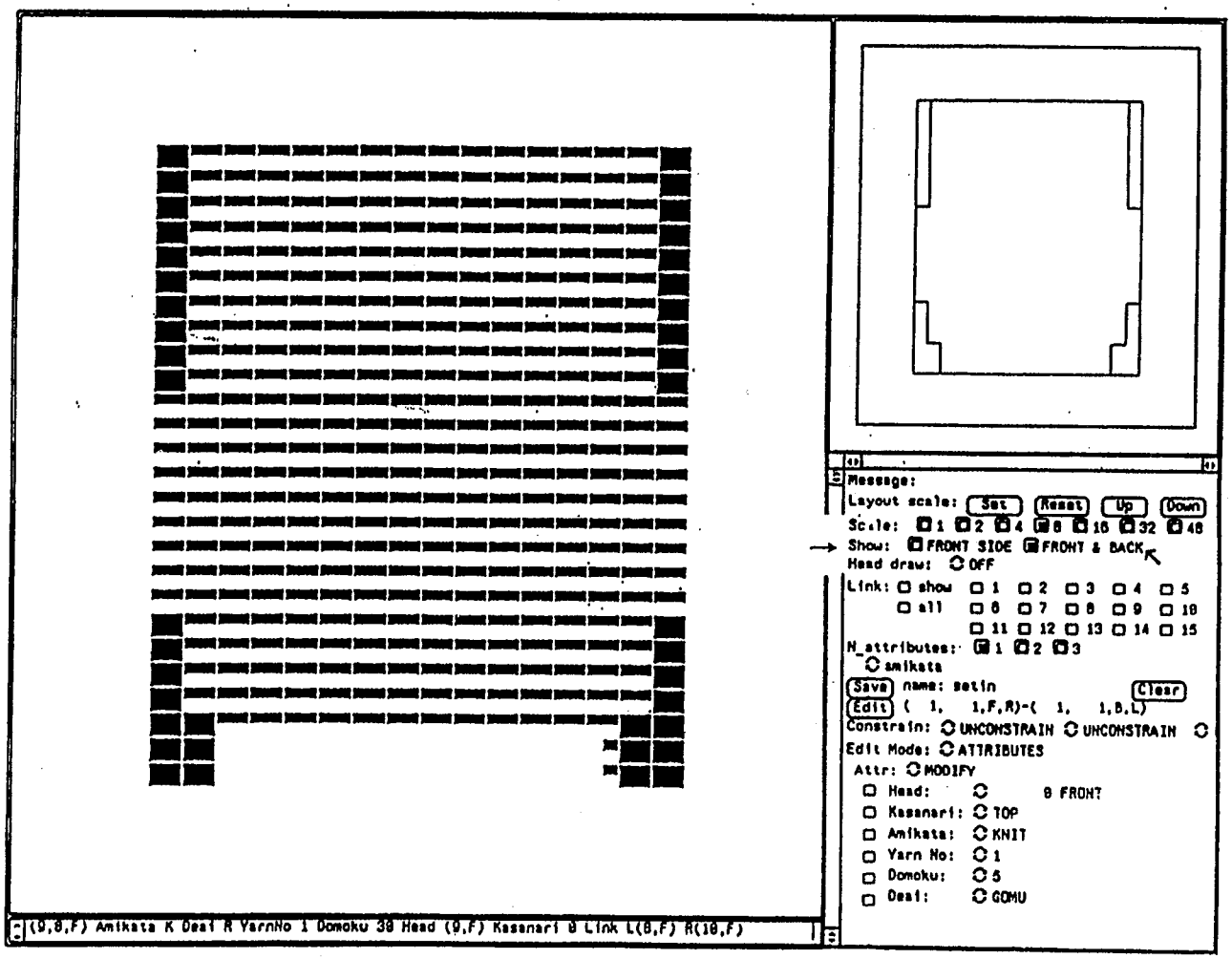
FIG. 18 is a schematic diagram showing a display of the back of a fabric in the knit pattern design processing of the embodiment according to the present invention.

The fabric canvas area of the present embodiment has the following display functions:

(1) A function for displaying a knitted final fabric state as shown in FIG. 14 (which corresponds to the fourth aspect of the present invention);

(2) A function for displaying an input design data (FIG. 15) associated with the stitch at a specific position;

(3) A function for moving a display range;

(4) A function for changing a display scale of stitches (scaling up/down of stitches) (corresponding to the sixth aspect of the present invention);

(5) A function for displaying a mark at a specific position, (6) A function for graphically displaying specific attribute parameters in the design data (see FIGS. 16 and 17) (corresponding to the fifth aspect of the present invention);

(7) A function for displaying front/back fabric state (see FIG. 18) (corresponding to the seventh aspect of the present invention); and (8) Others.

These display functions are selected by specifying a function selection switch on the operation panel using the coordinate input unit 120.

The display procedure associated with the present invention will be described later.

The operator uses the above display functions in order to correct the inputted data while confirming the fabric state and the design data inputted on the display screen, and to design the knit pattern.

The CPU of the engineering workstation 140 identifies the content of an instruction inputted from the keyboard input unit 110 or from an instruction switch on the display screen, and conducts the display processing according to the individual instruction contents (step S2500, which will be described later), data correction processing (step S2065), and other processings (step S2075). The data correction processing is performed by overwriting the inputted attribute information to be used for correction and to be used for correction and to be associated with the design data, on the attribute information that has been stored in the internal memory of the engineering workstation 140. In this case, the CPU and the keyboard input unit correspond to the correction means of the third aspect of the present invention.

Figure 19:
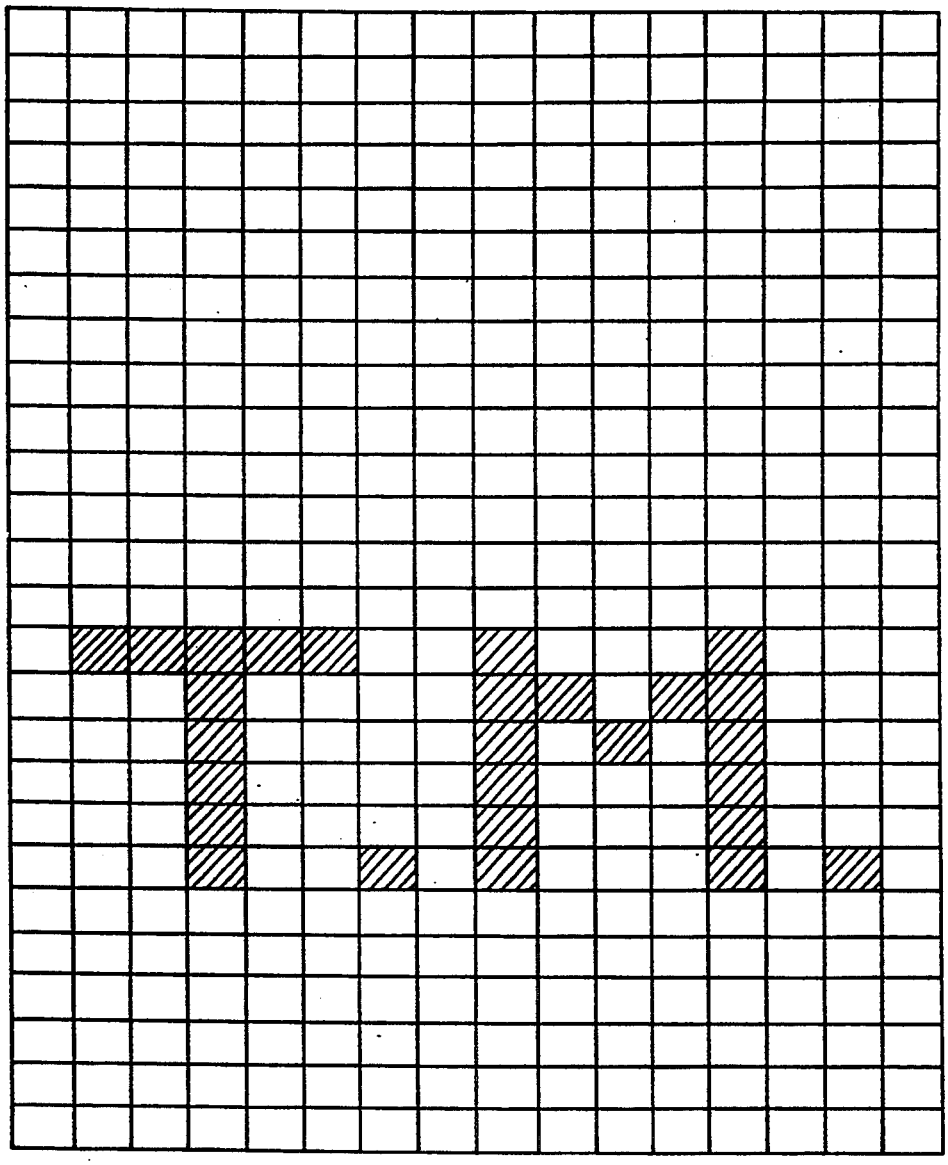
FIG. 19 is a schematic diagram showing a jacquard pattern sample in the knit pattern design operation processing of the embodiment according to the present invention.

As an example of the knit pattern design, an operator's instruction procedure and the image display for preparing the design data for a two-tone jacquard which includes initials "T" and "M" in a back texture of a bird's eye as shown in FIG. 19 will be described.

(1) The design data for a fabric without a pattern is read from the floppy disk to the internal memory in the engineering workstation 140.

(2) Positions to be patterned are confirmed by using the yarn number display function. At this point, the no-pattern fabric shown in FIG. 19 is displayed on the screen.

(3) Since the entire stitches of this fabric use yarn number "1", the yarn number at the pattern insertion positions is changed to the yarn number of another color, for example, to "2". The positions where a yarn whose number is "2" is used are specified by using the coordinate input unit 120 for pointing the hatched portions in FIG. 19. As a result, the stitch portions associated with the yarn number "2" are displayed in a color different from those associated with the yarn number "1".

(4) The patterns are confirmed on the display screen and, if necessary, the pattern insertion positions are corrected by the above processing (3).

(5) The jacquard conversion function (program) is started by using the operation panel, and the course range to be subjected to the jacquard conversion is specified by pointing the range of pattern portions on the display screen by the coordinate input unit 120.

Figure 20:
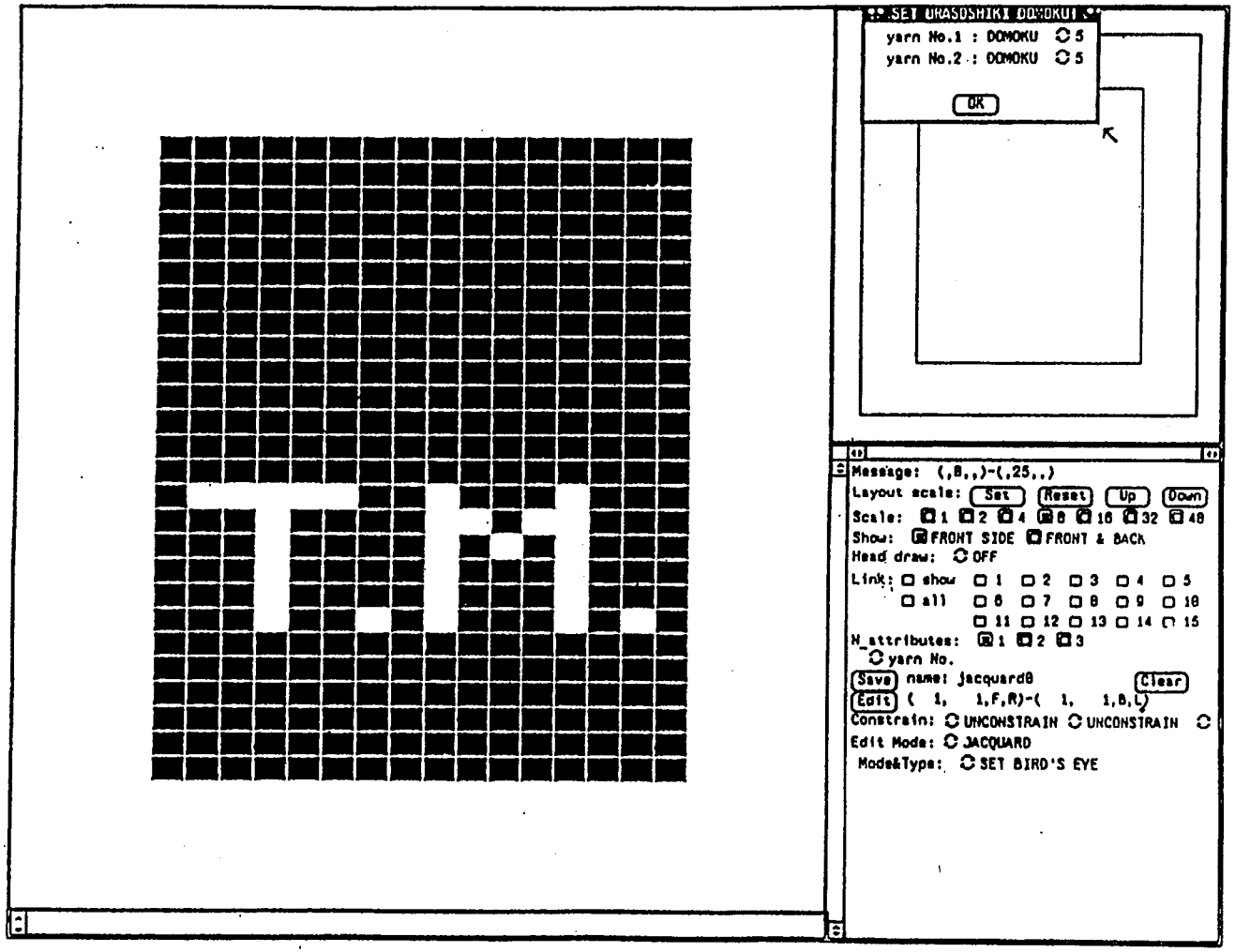
FIG. 20 is a schematic diagram showing a displayed image for setting a stitch length of a jacquard back texture in the knit pattern design processing of the embodiment according to the present invention.

(6) The back texture display function is selected to display the state of the back fabric as shown in FIG. 20, and then the type of the back texture (bird's eye) and the stitch length for each yarn number are entered.

(7) Instruct the execution of the jacquard conversion

By this jacquard conversion the design data is converted for the front texture in such a manner that a plurality of courses, each of which has a single yarn number, are arranged expansively, in ascending order of yarn numbers. For the back texture, the knitting manner pattern information of the selected type is incorporated into the design data.

In addition, other data conversions, and additional correction of the design data associated with the jacquard pattern such as loop head and the like are performed.

(8) The design data on which the jacquard conversion processing has been completed is stored on the floppy disk. It is also possible to store the completed design data on the floppy disk before the jacquard conversion and after the pattern designation, when necessary.

Although the engineering workstation 140 has other processing functions associated with the pattern design such as a setting and canceling function of an intarsia type and a function to insert a pattern in the form of a patch pattern, in addition to the above-described fabric display, the design data correction, and the jacquard conversion, these functions are not described in detail because they are not associated with the present invention.

After executing the above processings, the CPU of the engineering workstation 140 completes the control procedure in FIG. 13 in response to the end instruction from the operator, proceeds to the menu display processing of step S110 in FIG. 4, and waits for the next menu selection by the operator.

(C) A Knitting Procedure Preparation Processing

When the operator selects the knitting procedure preparation menu on the display screen, the CPU of the engineering workstation 140 transfers its control to the knitting procedure preparation processing in the sequence of steps S110–S120–S130–S140–S150–S3000.

Since the knitting procedure is prepared by using the above-described design data, the design data stored on the internal memory and the sequence data constituting the knitting procedure will be described first.

(a) The Design Data

The design data is broadly classified into size data and stitch structure data.

The size data comprises dimension data in which the fabric shape is represented with the fabric position and the number of stitches, a dimension unit, a knitting density, and a stitch length.

Figure 21:
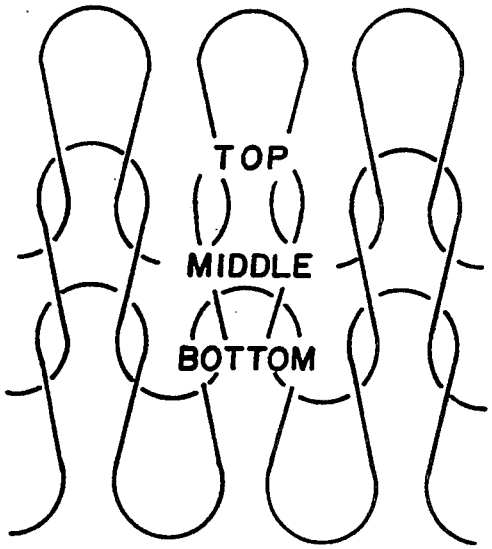
FIG. 21 is a schematic diagram for explaining stitch structure data of the embodiment according to the present invention.

The common stitch structure data associated with a stitch itself comprises data associated with the bottom of the stitch (called bottom data), data associated with the middle portion of the stitch (called middle data), and data associated with the top of the stitch (called top data) as shown in FIG. 21.

Figure 22:
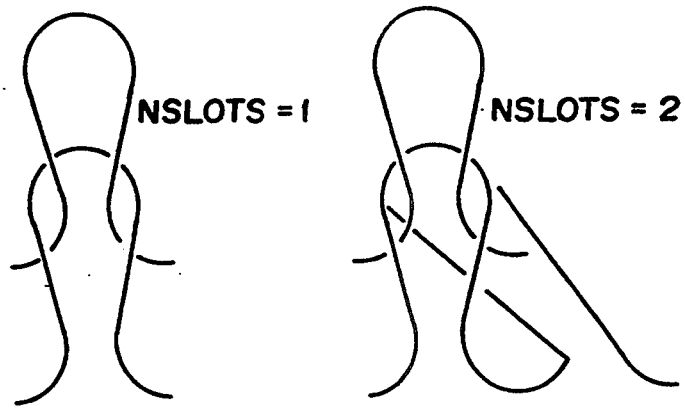
FIG. 22 is a schematic diagram for explaining stitch structure data of the embodiment according to the present invention.

The bottom data is associated with the stitch which is placed on the current needle before the knitting of the stitch, and its identification name is represented as nslots. More specifically, the name nslots represents the number of slots from which the current needle receives stitches of the prior course. For reference, stitch states for nslots=1 and nslots=2 are shown in FIG. 22.

The middle data indicates features of the stitches formed by knitting operation, including data on the type of particular stitches, a stitch length, an encounter (a bed), and a yarn (number and connection in the wale direction).

More specifically, the attribute information (also referred to as parameters) having the following identification names is provided.

head: One-bit information indicating whether or not the current needle takes the yarn in the knitting.

kousoku: One-bit information indicating whether or not the knit stitch is restricted.

nejiri: This indicates that the knitted stitch is in a twist state.

deai: This term indicates a reference encounter of a holding head employed in the knitting. For example, rib encounter is indicated by an identification code of "1", and double-sided encounter is indicated by "2".

domoku: The stitch length of a stitch to be knitted is indicated by a numerical value.

yarn No.: This term indicates a designation number of the yarn used in the stitch knitting.

yarnLS: This term indicates the direction of a stitch to which the left side yarn end of the described stitch is connected.

yarnLP: This term indicates the distance from the stitch at the present position to the stitch whose left side yarn end is connected, and also indicates the start and end of a yarn link and a type (A, B, C) of the intarsia stitch.

yarnLB: This term indicates a bed for producing the direction of a stitch which is connected to the left side yarn end of the stitch at the present position (value 1 indicates the back side bed, and value 0 indicates the front side bed).

yarnRS: This term indicates the direction of a stitch to which the right side yarn end of the stitch at the present position is connected (value 1 indicates the right, and value 0 indicates the left).

yarnRP: This term indicates the distance from the present position to the stitch to which the right side yarn end of the stitch at the present position is connected, and also indicates the start and end of a yarn link and a type (A, B, C) in the intarsia stitch.

yarnRB: This term indicates a bed for producing the direction of a stitch which is connected to the right side yarn end of the stitch at the present position (value 1 indicates the back side bed, and value 0 indicates the front side bed).

The top data includes the following data indicating the moving destination and the overlapping sequence (a value indicating the vertical positional relationship when stitches are intersecting or overlapping) of the stitch, which are necessary for stitch transfer.

headS: This term indicates whether the wale direction dislocation of the loop head against the knitting action point takes place in the increasing direction (right side) or the decreasing direction (left side) of the needle number.

headP: This term indicates an amount of the wale direction dislocation of the loop head against the knitting action point.

headB: This term indicates whether the head of a transfer stitch loop catches the back head or the front head.

kasanari: This term indicates by a numerical value the overlapping sequence when the stitch at the present position is intersecting or overlapping with another stitch.

The stitch types shown in FIG. 7 are represented by the terms head, kousoku, and nejiri among the parameters of the middle data described above.

Parameter values corresponding to some stitch types are shown in Table 1.

TABLE 1

| Stitch type | head | kousoku | nejiri |
|---|---|---|---|
| Knit without twist = | 1 = | 1 = | 0 |
| Knit with twist = | 1 = | 1 = | 1 |
| Tuck without twist = | 1 = | 0 = | 0 |
| Tuck with twist = | 1 = | 0 = | 1 |
| Welt = | 0 = | 0 = | 0 |

In the present embodiment, when the above common parameter values are inputted by the operator for a stitch, the CPU of the engineering workstation 140 stores expansively, for all the stitch positions constituting the fabric, the parameter values into the internal memory in the form of a table as shown in FIGS. 23 and 24.

Furthermore, with regard to stitch structure information such as the link start/end positions, only those for specific stitch positions are stored into the memory.

(b) Sequence Data

Sequence data (operation information of the first aspect of the present invention) describes the procedure for forming an objective fabric for the knitting operation of a general knitting machine. The sequence data includes the following elements:

(a) A knitting operation (having a yarn number, a knitting direction, a needle number, a needle operation, and stitch length as parameters).

(b) A racking operation (having an amount of the racking (head) movement as a parameter).

(c) A stitch transferring operation (having the needle numbers on the service side and the receive side as parameters).

(d) A dropping action (having the number of a needle as a parameter).

(e) An encounter setting operation.

(f) A pull-down tension setting operation.

With the six operations, all the fabrics knitted by an ordinary knitting machine can be produced. The sequence data is described in such a manner that the elements (a)–(f) in the sequence required for the knitting, are arranged. The sequence data is expressed by integers including the elements (a)–(f). The numerals and allocation of the individual operations will be described later.

The sequence data is structured as follows:

First, it has a space of several bytes as a head.

Next, for each yarn number, several bytes are assigned for information on the allocation of the used yarn number and the yarn carrier. Here, the first bytes for the information are blank, followed by the next bytes for the first yarn number. Use of the yarn number "1" is indicated by a bit of "1", and the use of each yarn carrier is indicated by another bit of "1". After that, information indicating ordinary knitting procedure follows.

The sequence data is formed by arranging each set of data in the knitting direction, the set of data corresponding to a row which is referred to as a course.

One course data is provided with an identification name COURSE, and is represented by (the course number), (operation information in the course), and COURSEend (an end code of the data).

The course number is an integer, is initialized to 1, and is incremented by 1 with each course. The operation information in the course includes the following elements which are arranged freely as needed.

The knitting operation information is provided with an identification name AMI, and is represented by (a yarn number), (knitting direction data), (needle operation data), and AMIend (an end code).

The knitting direction data takes one of the following:

RIGHT: rightward knitting

LEFT: leftward knitting

EQUAL: either direction.

The needle operation is represented as (a needle number), (a knitting manner), and (a stitch length), and sets of these information for the necessary number of needles are described.

The needle number is a numeral that is represented as follows, where n is the needle number.

a front needle is indicated as $n*2-1$, a back needle is indicated as $n*2$.

The knitting manner data is one of the following:

K: Knitting operation

T: Tucking operation

W: Welting operation

H: Returning operation

KQ: Knit twisting operation

TQ: Tuck twisting operation

The racking operation data is provided with an identification name RACK, and is represented as (a racking amount) and RACKend (an end code).

The racking amount is expressed in ½ needle pitch. The sign thereof is negative for leftward racking. The stitch transfer operation data is represented as MEsrv (an identification name of a needle on the serving side), MErcv (an identification name of a needle on the receiving side), and MEend (an end code).

The number of needles required on the serving and receiving sides are described for individual operations. Here, they must match each other.

The number used corresponds to the number of a needle in the knitting operation.

The dropping action data is represented as HAstart (an identification name of a drop needle) and HAend (an end code).

The number used corresponds to the number of a needle in the knitting operation.

The set data of the encounter is represented as DEAI (an identification name of the encounter) and DEAI end (an end code).

The encounter is either of the following:

GOMU: a rib encounter

RYOMEN: a confrontation encounter

This data is not used for setting the encounter, but for confirming if the present encounter agrees with the objective encounter. The default encounter is the rib encounter.

The pull-down tension setting data is represented as TEN (an identification name of pull-down tension) and TENend (an end code).

The pull-down tension is indicated by an integer from 0 to 255. The correspondence between the pull-down tension setting data and the actual tension is determined by the controller of the knitting machine main unit. The tension setting is used for changing when the next code is appeared after the code is appeared once, or used before the knitting operation is made.

In addition, an original point search code can be described between courses with the following identification name, if necessary.

ZRETall: searching for the original points of all motors

ZRETrack: searching for the original point of a racking motor

ZRETky: searching for the original point of a yarn carrier

ZREThari: searching for the original point of needles

The object of the present embodiment is to prepare the sequence data for a knitting machine for weft knitting. In the sequence data, the needle numbers are automatically allocated to the stitch positions in the course direction in a one-to-one correspondent manner. The above data (a) to (e) are automatically prepared using the individual parameters of the design data. The other data take predetermined default values unless the operator inputs them for indicating.

Furthermore, these sequence data groups are developed and stored on the internal memory of the engineering workstation 140 in the form of a table for each stitch position in the sequence conversion processing described below.

(c) Conversion to the Sequence Data

The preparation of the knitting operation data for the knitting needles in the sequence data will be described as an example.

Figure 25:
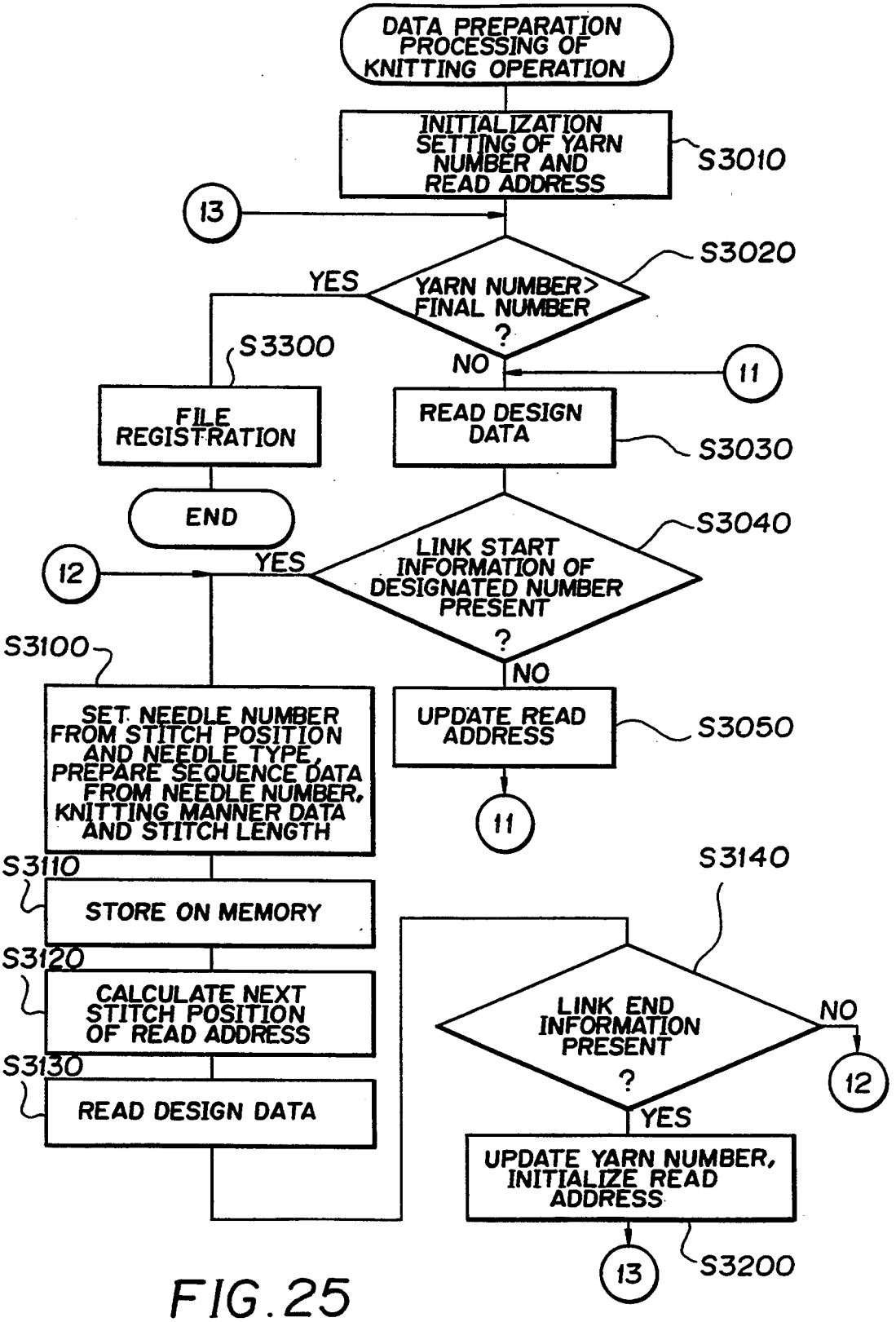
FIG. 25 is a flow chart showing a knitting operation data preparation procedure of the embodiment according to the present invention.

FIG. 25 shows the preparation procedure of the knitting operation data.

In the present embodiment, in view of the fact that the stitch (loop) is formed by the knitting operation of the knitting needles, the sequence in which the stitches (more precisely, loop heads) are continuously formed, and their stitch positions are found for a yarn (a particular yarn number) among the design data groups stored in connection with the stitch positions. Then, parameters associated with the sequence data are retrieved from the design data at the stitch positions corresponding to the formation sequence, and the parameters are used to prepare the sequence data.

Since the detected stitch positions have one-to-one correspondence with the positions where the knitting needles operate (that is, the positions for knitting, transferring, and the like), it can be converted to the knitting needles instructed to be driven.

For this reason, the CPU of the engineering workstation 140 performs the following search processing on the design data groups stored in the memory.

Specifically, referring to FIG. 25, the yarn number to be searched for is initially set to "1" (step S3010), and the design data is read beginning from the read start position of the memory (a loop processing consisting of steps S3020–S3030–S3040–S3050–S3030). When the CPU detects in step S3040 that the link start information of yarn number "1" is included in the design data, the CPU transfers the procedure to step S3100 to retrieve the knitting manner data and the stitch length data from the read design data. Furthermore, the CPU reversely calculates the stitch position from the presently read address, and then sets the needle type data and the needle number (as well as the needle type) corresponding to the stitch position in the design data. Furthermore, the sequence data (knitting operation data) including a set of the needle numbers, the knitting manner data, and stitch length data is prepared, and are stored in the memory (steps S3100–S3110).

The CPU further calculates the next stitch position to be connected to the present stitch by using the information on the position and distance of the stitch to be formed next along the knitting direction of the yarn, and computes the read address of the memory corresponding to the calculation result in accordance with the link-related information in the design data which has been read. Then, the CPU reads the design data at that address (steps S3120–S3130).

Thereafter, the loop processing of steps S3140–S3100 to S3140 is repeated until the link end information is detected in step S3140. Thus, the CPU sequentially detects positions where stitches are to be continuously formed, that is, the knitting positions, forms the knitting operation data on the basis of the design data, and stores them in the memory.

Thus, after storing the driving sequence of the knitting needle for the yarn of number "1" in the form of knitting operation data, the CPU updates the yarn number to "2", and returns the procedure to step S3020 when the link end is detected (step S3140).

Subsequently, after detecting the link start position of the yarn of number "2" in the loop processing of steps S3030–S3050 in a manner similar to those described above, the CPU stores the driving sequence of the knitting needles corresponding to the stitch formation sequence in the loop processing of steps S3100–S3140.

When the above processing is completed for all the yarn numbers (step S3020), the sequence data prepared is registered on the floppy disk as a file by the operator's instruction (step S3300). Then, the CPU ends the execution of the present control procedure.

In the present embodiment, since the other parameter data of the sequence data can be prepared in the same procedure except for the case where the other parameter data is used in substitute for the knitting operation data, description of the preparation procedure of the other parameter data is omitted.

For reference, an example of the knitting operation data prepared in the procedure described above is shown below.

| Yarn No. | Needle No. | Knitting operation sequence |
|---|---|---|
| 1 | | (f102, k,30)-(f103, k,30)-(f104, k,30) . . . |
| 2 | | |
| . | | |
| . | | |
| . | | |

wherein f is an identification code indicating the front needle, k is an identification code indicating the knitting manner (knitting operation), and 30 is a numeral indicating the stitch length.

(D) Conversion to the Control Data

Figure 26:
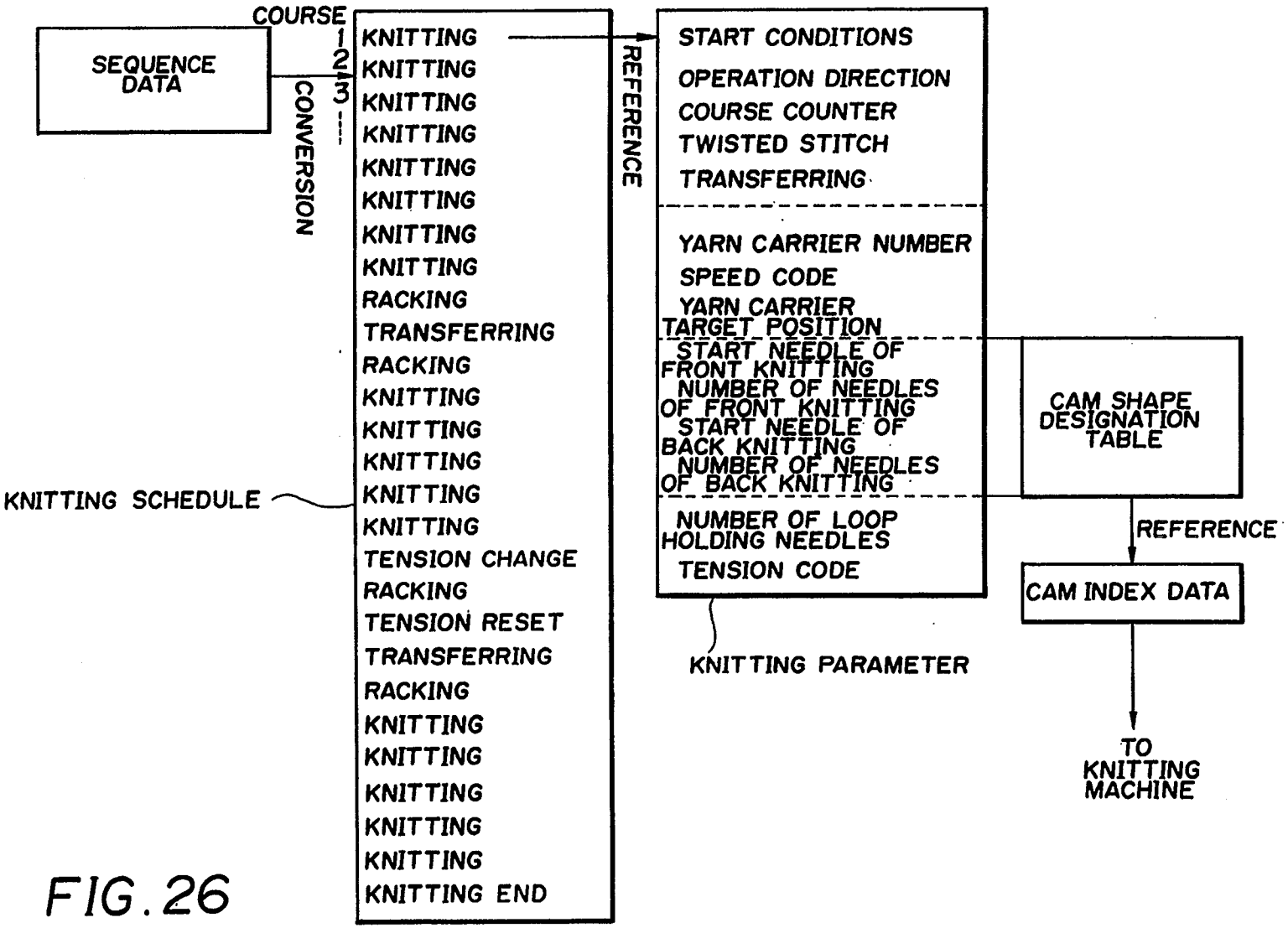
FIG. 26 is a schematic diagram showing a construction of the control data of the embodiment according to the present invention.

Before describing the conversion processing, an arrangement of the control data used for a flat knitting machine is shown in FIG. 26. The control data is based on the knitting schedule. The knitting schedule is composed of the basic operations of the knitting machine, which are arranged in the sequence required for knitting. The basic operations mainly comprise the knitting, racking, transferring, and tension changes, with some instructions to control the knitting schedule. Knitting here means one yarn-carrier operation, and a withdrawal operation also constitutes one knitting operation. The instructions and their parameters are described below.

In knitting, the knitting parameters are referred to first. The knitting parameters indicate the designation of a yarn carrier, a target value of the operation, start conditions, knitting ranges, a pull-down tension setting value, and the like. In addition, it is necessary in actual knitting to set a cam pattern (which varies depending on the stitch length and the yarn type) for each needle in the knitting range. A table storing these cam patterns is a cam shape designation table. This table allocates a predetermined cam number to each needle in the knitting range. The present embodiment can use 97 cam numbers. This includes one for mis-operation, 48 for knit and tuck operations, respectively. Since the knit and tuck operations must be used as a pair, 48 types of cams (stitch length codes) of different stitch length and yarn type can be used. Cam index data indicates the types of the 48 common cams in a piece of the entire fabric. This ASCII file indicates the stitch length and yarn type for each stitch length code. On the basis of this data, the knitting machine main unit searches the database to convert into an actual cam pattern according to this data.

For transferring of the stitch, the parameters identical to the knitting parameters are provided. The range of transfer needles is determined by the knitting parameter, and the needle corresponding to it is instructed as one of the receiving side, the serving side or the non-operation in accordance with the cam shape designation table.

For other instructions that require parameters have parameters of predetermined bits in the parameter table.

The end of knitting end is indicated by the knitting end instruction in the knitting schedule. In addition, conditions for starting knitting, history of the control data, and the like are also stored in the cam index data.

In order to store the above individual tables as files, each table name is provided with an identification name. Each file has a header comprising a unit size of its data, the number of data, a table identification number, and a table version number. The knitting machine parameter file attached to the knitting machine main unit is provided with another identification name so that it is distinguished from the control data file.

Contents of each table will be described below.

(a) The Knitting Schedule

The end of the data constituting the knitting schedule is indicated by an end code added at the end position of the data. The knitting schedule uses codes specifying the following knitting operations. These are a no-operation; a practice knitting operation; a racking (an argument of 1 corresponds to half the needle pitch, and indicates the rightward movement of the back bed when it is negative); a transferring of the stitch; a pull-down tension change (an argument is a tension code); a pull-down tension reset; a yarn catcher operation; a yarn cutter operation end; a knitting end; an original point search; a return to original point; a front/back down stitch code; and the like.

(b) The Parameter Table

This table stores data necessary for knitting in the form of parameters, except for data of individual needles for respective courses. In addition to the data associated with the knitting, it also stores the data associated with withdrawal of the yarn carrier and with transferring of the stitch. Contents of the data and parameters are as follows:

Contents of the data:

Contents of the parameters

1) A start condition:

The data of 0 indicates that knitting is performed following the previous yarn carrier. The data of 1 indicates that all the yarn carriers must be stopped before the knitting is started. The data of 0 also indicates that checking whether or not continuous knitting is possible is also made by the knitting machine main unit.

2) A knitting direction:

The data of 0 indicates the rightward knitting, and the data of 1 indicates the leftward knitting.

3) Course counter count-up:

This data indicates the start of knitting of each row. A parameter of 1 indicates the increment of the course counter, while that of 0 indicates no-operation.

4) A twisting course:

The data of 0 indicates a normal knitting course. The data of 1 indicates that this course is a twisting course.

5) Transferring of the stitch:

The data of 0 indicates a knit operation, while that of 1 indicates a transferring operation.

6) A yarn carrier number:

The data indicates yarn carriers 1–12 by the numbers 0–11.

7) A yarn carrier speed:

The data indicates a yarn carrier speed by a code. The actual speed is measured at the side of the knitting machine main unit for each code. It is normally used as follows:

0—set up, 1—normal knitting,

2—adjustment 1, 3—adjustment 2.

8) A tension code:

The code indicates the tension set value corresponding to the number of loop holding needles.

The actual value is set in accordance with this code by the knitting machine main unit. It is normally used as follows:

0—normal knitting, 1—transferring,

2—adjustment 1, 3—adjustment 2.

9) A yarn carrier operation stroke:

The data indicates the target position of the yarn carrier that operates in the current course by using an absolute position with regard to the front bed. For this purpose, (the front needle number * 2) is used. It can take a negative value. The front needle number takes a value 0 for the needle of number 1.

10) The front knitting start needle number; the number of the front knitting needles; the back knitting start needle number; and the number of the back knitting needles:

These data indicate the operation range of the needles with regard to the yarn carrier operation. The start needle number 0 corresponds to the needle of each number 1 bed. The number of a knitting needle of 0 indicates that knitting is not performed in that bed. When both front and back are 0, the yarn carrier makes a withdrawal operation.

11) The number of loop holding needles:

The data indicates the number of needles currently holding loops in order to instruct the pull-down device. It is converted to the actual tension set value at the side of the knitting machine main unit using the tension code.

12) Unused data:

It is used for matching the delimitation of data, and is represented by 0's.

For a transferring course, for example, the first data is represented as 0000100000000000000xxxxyyyy0000 (xxxx indicates a speed code, and yyyy indicates a tension code, both being valid), and the target position of the yarn carrier is indicated as 0000000000000000, and the remaining data are valid.

In general, the start condition is a continuous one. Conditions for a restart after an interrupt include the following:

1) The case where operation instructions are continuously fed to the same yarn carrier.

2) The case where the operation direction is reversed to that of the previous yarn carrier.

3) The case where the previous yarn carrier is not separated apart by a predetermined distance from the present yarn carrier.

(c) A Cam Shape Designation Table

In this table, data associated with each needle is indicated in a predetermined number of bytes, and the data for one course is arranged in the sequence of courses. The number of bytes required for each course is determined by the number of the front and back knitting needles of the knitting parameter table. An end code is provided at the end of each course data. This is for facilitating the reading of the entire data in each course. The data described here are cam numbers, and the actual operation is specified by the cam index data.

The cam numbers used in the knitting operation include 96 numbers from 0 to 95, for example, and the even numbers are for a knit operation whereas the odd numbers are for a tuck operation, which are used in pairs. Therefore, the number of combinations of a stitch length and a yarn type that can be actually used for one fabric is 48. These are the internal codes, and they are called as knit 0—knit 47, and tuck 0—tuck 47. The converted value is n * 2 for knit n, and n * 2+1 for tuck n. This number n is referred to as a stitch length number or a stitch length code. Values 128–249 indicate misoperations, but only 128 is actually used. Values 250–255 are reserved for use in other control. For the transferring operation, 0 is allocated to the service side, 1 is allocated to the receive side, and 128 is allocated to the no-operation.

The needles are assumed to be arranged in sequence as front and back. Nothing is mentioned about a bed without performing knitting. The code appearing first is the operation code of the knitting start needle.

(d) Cam Index Data

The cam index data is valid for an entire fabric. The data file has no header. This data describes a stitch length and a yarn type for each stitch length code used in the cam shape designation table. This file has the original design data name as a comment. It also has data about the data number and the data version. The stitch length values and the yarn types used in this file are the very values set by the design data and the sequence data. Their meanings, however, are determined by the program that converts them to the actual cam shapes. When the knitting machine main unit reads the cam index data to form cam shapes, they are converted to cam numbers at a same time for knit operation and tuck operation In the present embodiment, the above-described knitting schedule, knitting parameter table, cam shape designation table, and cam index data table, which correspond to the type of knitting machine, are created by rearranging the knitting sequence of the entire fabric for individual yarns indicated by the sequence data to the knitting sequence for individual courses.

Figure 27:
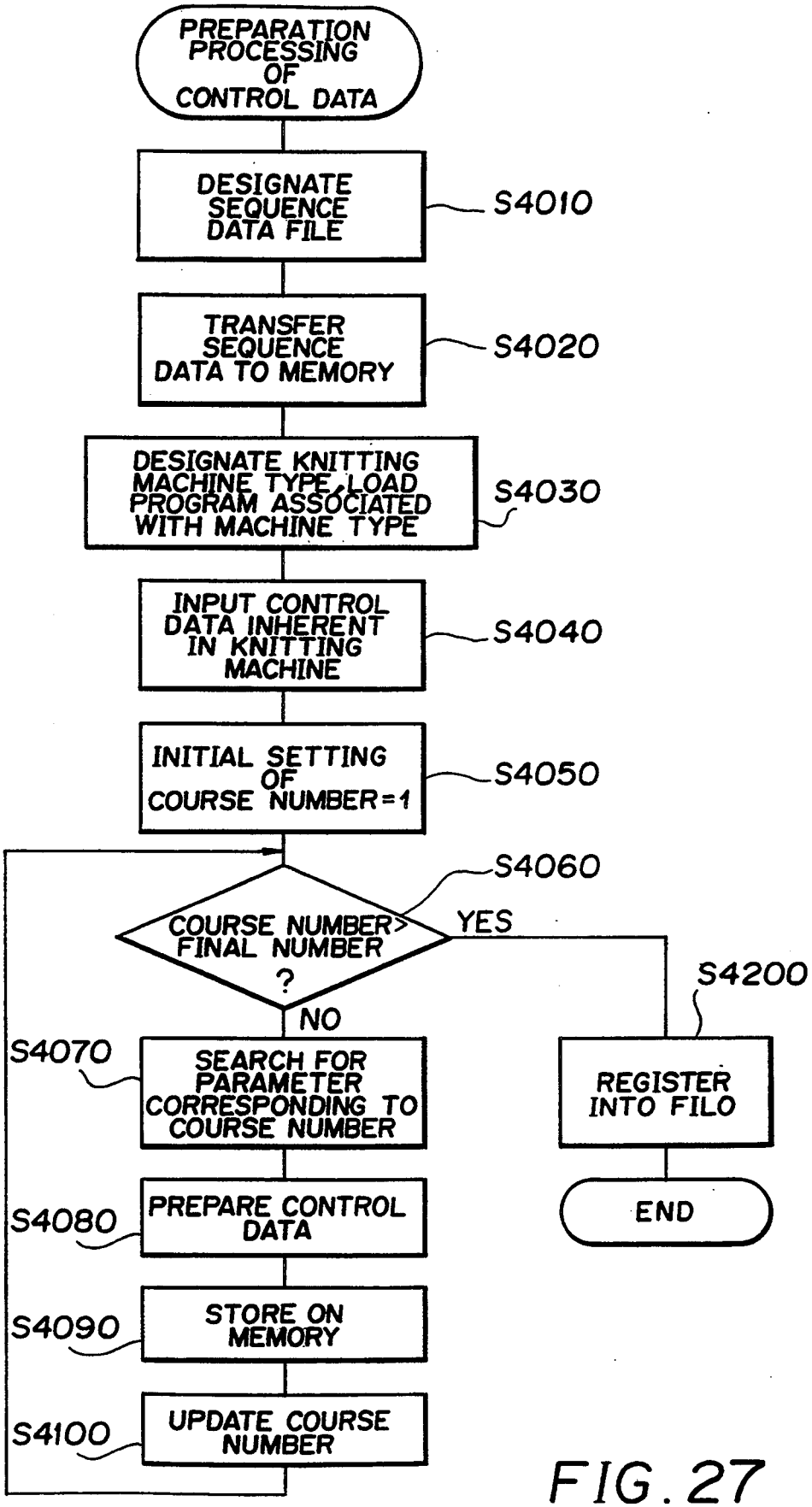
FIG. 27 is a flow chart showing a control data preparation procedure of the embodiment according to the present invention.

When the operator selects the control data conversion processing in the menu image on the display of the engineering workstation 140 (step S120 in FIG. 4), the control data conversion processing is started in the sequence of steps S130–S170–S4000. Details of the procedure of the conversion processing are shown in FIG. 27.

The operator designates by the keyboard input unit 110 a sequence data file to be converted to the control data (step S4010). The CPU of the engineering workstation 140 reads the specified sequence data file from the floppy disk, and transfers it to the internal memory (steps S4010–S4020).

Then, the CPU receives the machine type information of the knitting machine in the control data which has been prepared based on the input from the operator. The CPU loads the control data preparation program corresponding to the machine type information from the floppy disk on the internal memory, and thereafter performs calculation according to the data preparation program (step S4030).

The CPU first stores in the internal memory the control data inherent in that knitting machine, which cannot be covered by the sequence data (step S4040).

Then, the sequence data in the internal memory, which is arranged in the individual yarn numbers, is searched for over the range specified by the range information so that the parameters necessary for preparing the control data are extracted in accordance with the course number. More specifically, the course number "1" is set as the search object, and the parameters associated with the above control data are extracted from the range corresponding to the course number "1" and the first yarn number in the sequence data. In this case, the contents of the types of the parameters to be extracted and the relationship between the parameters of the control data and the sequence control data, are defined in the program in the form of a numerical calculation equation or a logical operation equation.

Then, the CPU prepares the control data in accordance with the relationship previously defined in the program and by using the extracted parameters of the sequence data, and stores the result in the memory. After that, the same processing is performed repeatedly on the sequence data of. Next yarn number and the following yarn numbers in the course number.

Thus, after preparing the control data successively along the wale direction to obtain the control data for one course (steps S4070–S4090), the CPU updates the course number, and prepares the control data in the sequence of the course number. After preparing the control data over the range specified by the operator (step S4060), the CPU registers in the file, according to the file instruction from the operator, these control data individually in the form of tables for the respective types as shown in FIG. 26.

The thus file registered control data are read from the floppy disk by a transfer instruction of the operator from the keyboard input unit 110, and are transferred to the knitting machine control panel 320 shown in FIG. 2. The knitting machine carries out the knitting operation by the conventional method known in the art, according to the control data.

(E) Control Data Display

When the operator selects the control data display processing in the menu select image on the display screen (step S120 in FIG. 4), the execution procedure of the CPU of the engineering workstation 140 proceeds to steps S130–S170–S5000 to display the control data. In this processing, the CPU receives the identification name of the control data from the operator, reads the corresponding control data from the floppy disk, and displays it. It is also possible for the operator to watch the display screen, and input correction information from the keyboard input unit 110 to change the control data.

Next, processing in the engineering workstation 140 associated with the present invention will now be described.

a) A development processing of the stitch structure data on the memory storage

Since a common stitch structure is used in a specified range of the fabric in the present embodiment, the operator inputs for instruction only the stitch structure of a single stitch only in the form of a characteristic parameter. The present embodiment is characterized in that the engineering workstation 140 allocates the inputted characteristic parameters to the individual stitches of the specified range in order to represent the stitch structure of the entire fabric. For this purpose, in the present embodiment, the same characteristic parameters as the inputted characteristic parameter are stored at the individual memory locations corresponding to the stitch positions.

Furthermore, a memory area for storing the above characteristic parameter group is established for a single stitch. Next, a plurality of the memory areas are provided for the stitches in the range in which the shape is specified. In addition, each stitch position is made to have one-to-one correspondence with each memory area location on the memory.

When the characteristic parameter is displayed on the display screen, display addresses are calculated according to the individual memory addresses.

b) Input (design) data display b-1: Shape display

Figure 10:
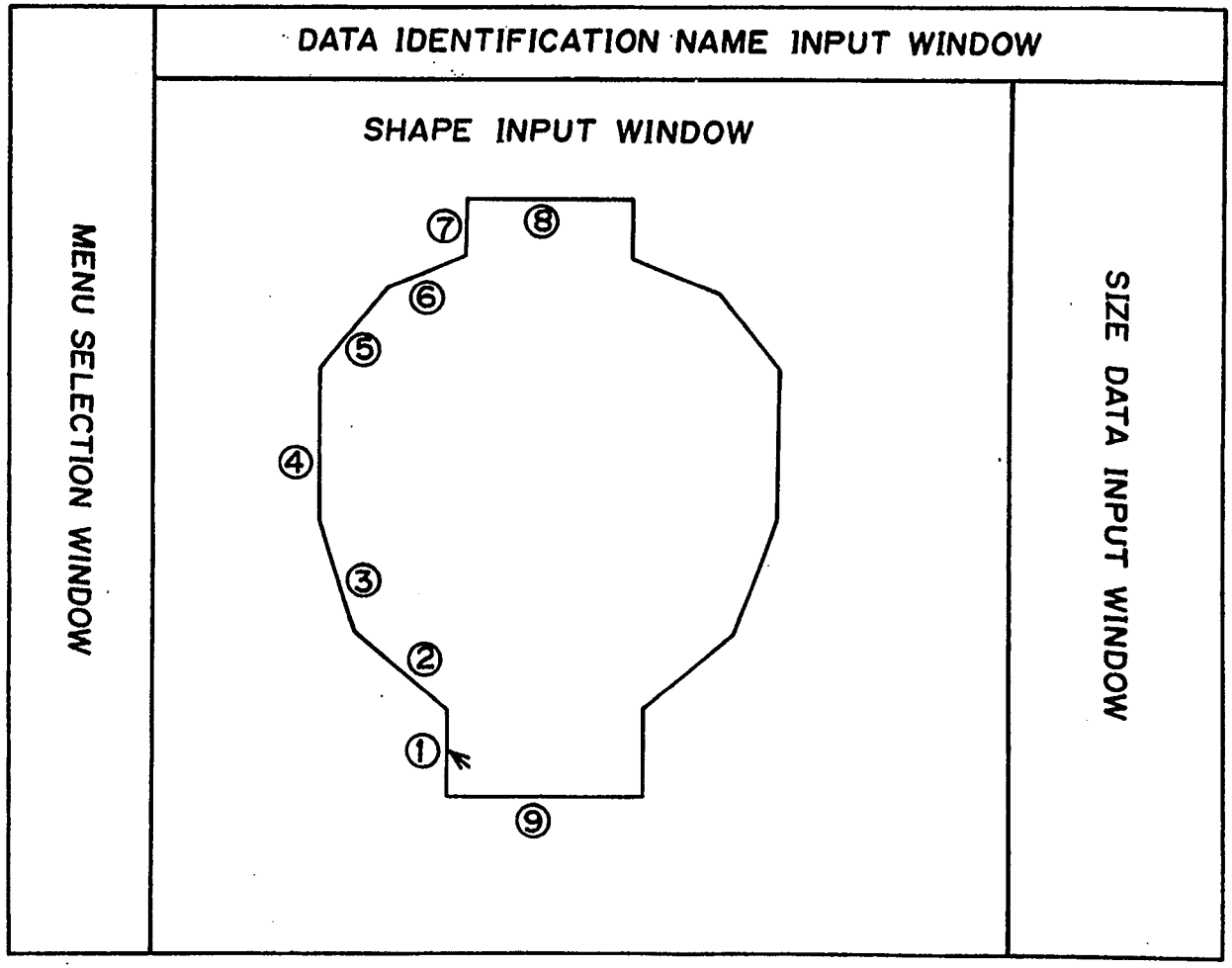
FIG. 10 is a schematic diagram for explaining an input operation of fabric shape information of the embodiment according to the present invention.

In the present embodiment, the size data of FIG. 6 are inputted by specifying the positions on the display screen as shown in FIG. 10. The input data are displayed in a contour pattern proportional to the sizes as shown in FIG. 12. It is also displayed during the pattern setting as shown in FIG. 14. Since the operator can visually confirm the fabric shape to be prepared, even if an error is made in setting the stitch numbers of the fabric, he can immediately be aware of it.

Contour display can be achieved by preparing a dot image by connecting with a line segment adjacent end points in a plurality of end points determined by the shape sizes inputted, and then displaying the dot image on the display unit.

b-2: Stitch arrangement display

In the stitch arrangement display, the portion partitioned by a view port in the layout canvas is displayed. The size of the view port is determined in terms of the stitch number according to the specified magnification. The portion selected by the view port is enlarged and displayed on the stitch canvas. The display is shown as a rectangle partitioned by straight lines in the stitch canvas, and the parameters are represented by inside colors and graphics overlapped thereon. The size of the rectangle is determined for each magnification in terms of a pixel value on the screen. The frame of the rectangle is usually displayed in white, and in the portions other than the fabric, a rectangle indicating stitches is display in black.

b-3: Graphic display of parameters

In the present embodiment, in order to learn the final knitted state of the fabric, a plurality of pieces of parameter information showing the fabric structure such as links for the individual yarn numbers (FIG. 17) are graphically displayed. To display the parameters, graphic patterns indicating types of parameters are previously stored in the ROM of the engineering workstation 140 or in the floppy disk, and dot images showing the above stitch arrangement and the graphic patterns are synthesized on the memory. It is needless to say that the positions and number of graphic patterns are determined by the inputted parameter values and stitch arrangement.

Figure 28:
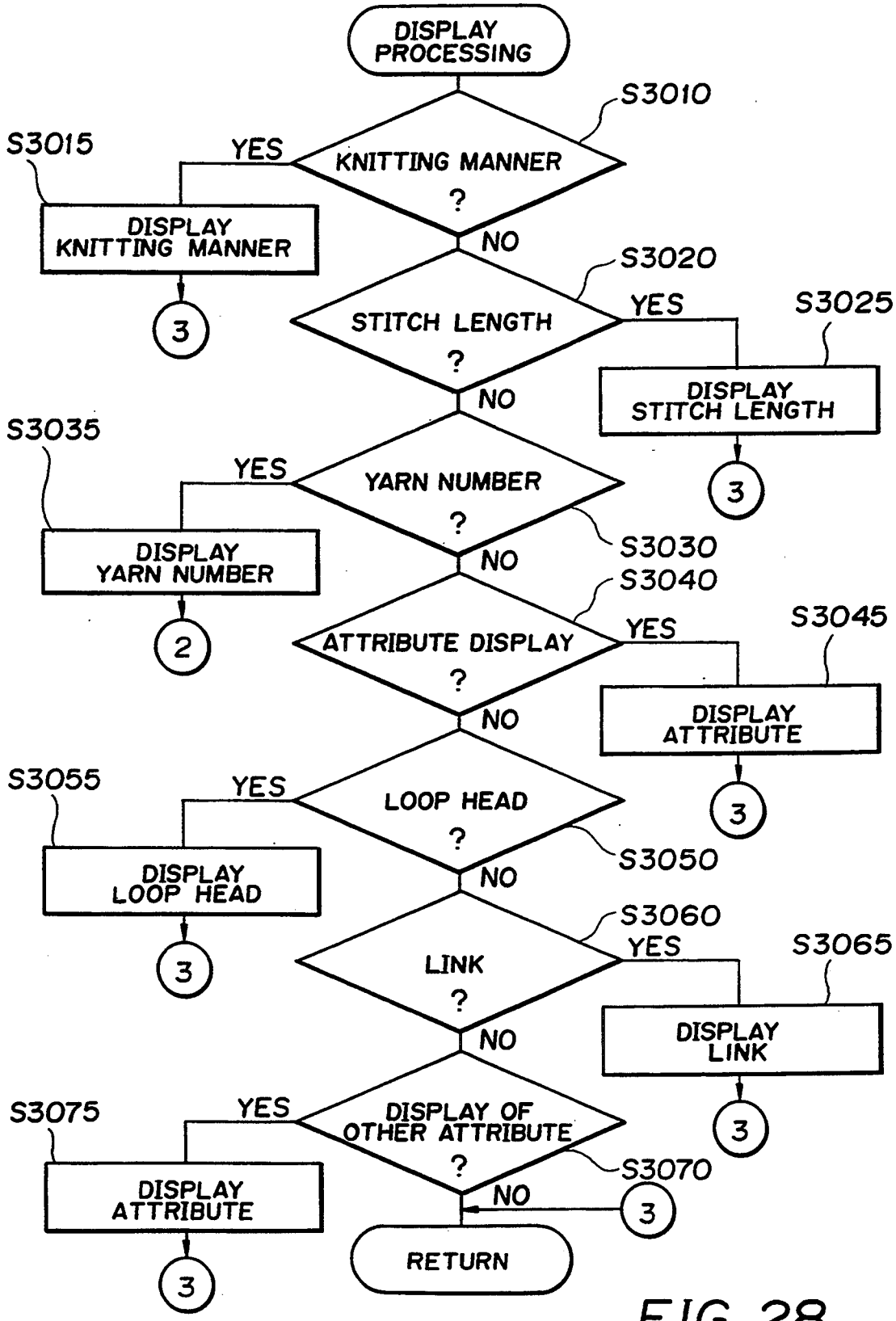
FIG. 28 is a flow chart showing a fabric-related data display procedure of the embodiment according to the present invention.

When the contents of the data to be displayed are designated by the operation parameter during the stitch pattern design, the CPU of the engineering workstation 140 interrupts to execute the control procedure shown in FIG. 28. More specifically, the instructed contents are identified, and the instructed data contents are displayed using the above display sizes.

In the present embodiment, the state display is possible by graphic patterns associated with the following parameters.

Figure 16:
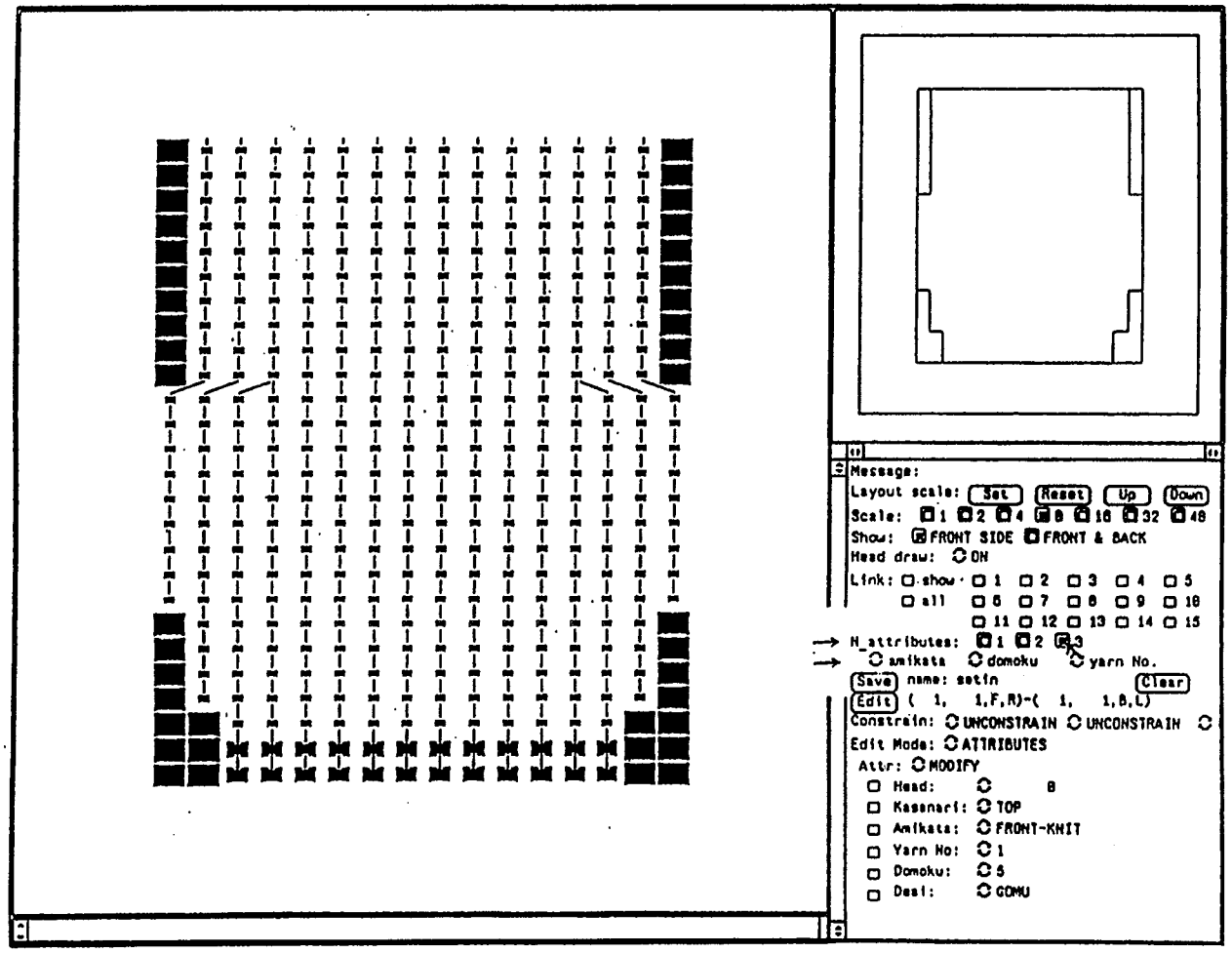
FIG. 16 is a schematic diagram of a display example showing a knitting manner in the knit pattern design processing of the embodiment according to the present invention.
Figure 17:
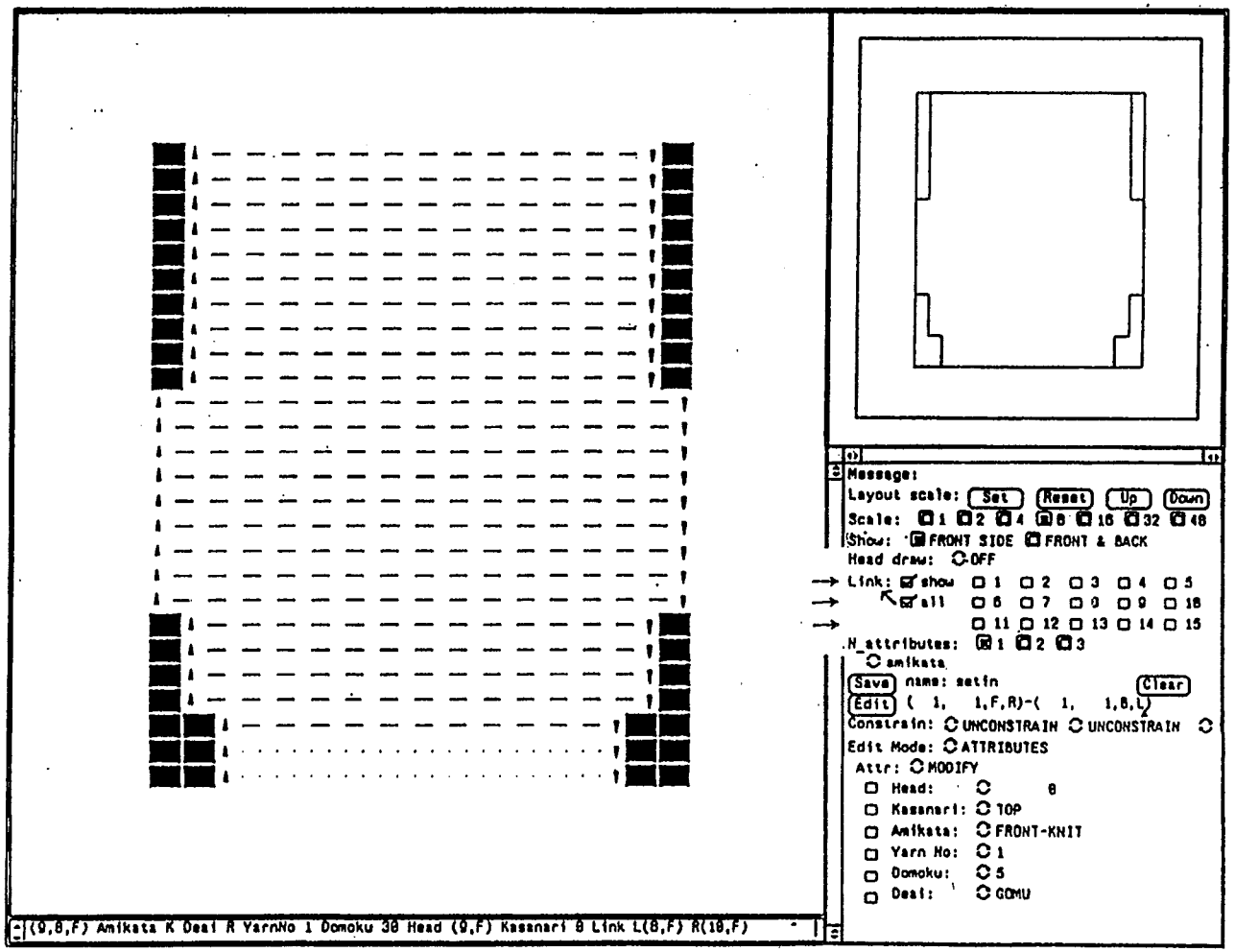
FIG. 17 a schematic diagram showing a link display in the knit pattern design processing of the embodiment according to the present invention.

(a) Same knitting manner data:

The type is indicated by a color outside a small rectangle in FIG. 16.

(b) A stitch length:

A stitch length is indicated by a color inside the rectangle in FIG. 16.

(c) An yarn arrangement with the same yarn number:

This arrangement is display by dash-dotted lines in FIG. 16.

(d) A loop head:

The loop head is displayed by a straight line from a stitch to the destination stitch. The line color corresponds to the yarn number. With regard to the loops whose head lines intersect, the upper and lower relationship of the loops is indicated. A stitch without the line of a loop head becomes a drop.

(e) A link:

The link is displayed by a straight line connecting hands of stitches. The line color indicates a yarn number (see, FIG. 17). A triangle mark and a reversed triangle mark (where are they in figure) indicate ends. When an intarsia type is set, the type is indicated by an alphabetical letter.

It is also possible to select and display a plurality of types of these attribute parameters simultaneously.

Furthermore, the above-described contour image and stitch image of the fabric are prepared and synthesized by the CPU 141 on the memory (video RAM 146) in the engineering workstation 140. Therefore, the CPU 141 and the video RAM 146 operate as the first to third image processing means (first to third image processing means 3100–3300 in FIG. 1) of the fourth aspect of the present invention.

c) A manner of representing relationships used for the design data/sequence data conversion and the sequence data/control data conversion.

The relationships between two data used for the data conversion are represented as follows.

c-1: When a parameter B after the conversion is represented by a plurality of parameters A1–An before the conversion, one of an equation like B=A-1+An (including coefficients), a logic equation like if A1="0", then B="1", and a vector equation like B=(A1, A2, . . . An) is used.

c-2: For those including a condition, a logic conditional equation is added to the above equation.

In the present embodiment, although these equations are defined in the data conversion program, they can be readily modified if they are stored on a floppy disk in the form of a table, and a desired equation is used in the data conversion.

Next, an efficient usage of the present system will be described.

Once the design data, the sequence data, and the control data have been synthesized in the procedure described above, the individual data are registered in a file on a floppy disk along with their identification names. Therefore, when the pattern and the stitch structure of the fabric are to be modified, the design data on the floppy disk is loaded on the engineering workstation. The operator causes the fabric to be displayed on the display screen, and adds corrections on necessary portions of the design data to prepare new fabric design data. Then, the design data is registered in the file on the floppy disk with a new identification name. Such a processing will reduce an amount of information to be inputted by the operator, thus simplifying the input operation.

When the operator manually inputs the control data for a knitting machine which cannot be connected to the present system, it is preferable that the sequence data be outputted to a printer for printing. Since the sequence data indicates the knitting procedure such as driving operations of the knitting needles and the bed, mis-setting will be reduced when the control data is set according to the knitting procedure.

In addition to the present embodiment, the present invention can implement the following examples.

1) Although the present embodiment assumes one of a plurality of types of double-sided flat knitting machines as a machine that can be connected to the system, the present invention can also be applied to other types of knitting machines such as a circular knitting machine as well.

2) Although the present embodiment transmits the control data to the knitting machine through a network line, the control data can also be inputted to the knitting machine via a portable storage medium such as a floppy disk.

3) Although in the present embodiment, the programs and various data used in the engineering workstation 140 are stored in the floppy disk, they can also be stored on a hard disk or other storage media. Furthermore, it is needless to say that a plurality of types of the above storage media may be used in combination.

For reference, differences between the present invention and the recording apparatus described in U.S. Pat. No. 4,608,642 and the knitting machine described in U.S. Pat. No. 4,768,357 will be described. The recording apparatus of U.S. Pat. No. 4,608,642 prepares the control data for driving the knitting machine, when the operator inputs information indicating the knitting operation in the form of color codes rather than in the form of design information as in the present invention. In contrast, in the present invention, the knit design system automatically prepares the information indicating the knitting operation, and the control data for driving the knitting machine, when the operator inputs the design information indicating a stitch structure and the like constituting the fabric. Since the operator can input data without considering the knitting sequence, the input operation can be simplified.

In the knitting machine of U.S. Pat. No. 4,768,357, the operator must prepare the knitting machine driving control data itself. Thus, unlike the present invention, the control data for driving the knitting machine cannot be prepared from the design data.

With the present invention, the operator can learn the state of the finished fabric by visually confirming the fabric image displayed on the display unit, thereby eliminating the need for trial knitting as required in the prior art. In addition, since the input design information is automatically converted to the operation information and the control information indicating the knitting procedure, the operator's burden for setting control information to various types of knitting machines is remarkably reduced.

What is claimed is:

1. A knit design system, comprising:

input means for inputting design information that indicates a shape of a fabric to be knitted and a stitch structure, said stitch structure including head information, restriction information, twist information, stitch length information, yarn number and link information;

storage means for storing first calculation information indicating correspondence between said design information and operation information, said operation information including sequence data including knitting operation information, racking information, stitch transferring operation information, dropping action information, encounter setting operation information and pull-down tension setting operation that show a common knitting procedure for knitting machines; and calculation processing means for converting said design information inputted from said input means to said operation information on the basis of said first calculation information in said storage means.

2. A knit design system comprising:

input means for inputting design information that indicates a shape of a fabric to be knitted and a stitch structure, said stitch structure including head information restriction information, twist information, stitch length information, yarn number and link information;

first storage means for storing first calculation information indicating correspondence between said design information and operation information, said operation information including sequence data including knitting operation information, racking information, stitch transferring operation information, dropping action information, encounter setting operation information and pull-down tension setting operation that show a common knitting procedure for knitting machines;

first calculation processing means for converting said design information inputted from said input means to said operation information on the basis of said first calculation information in said first storage means;

second storage means for storing for each type of knitting machine second calculation information indicating a correspondence between said operation information and control information for driving the knitting machine;

designation means for designating a type of said knitting machine; and second calculation means for converting operation information which has been converted by said first calculation means into said control information corresponding to the designated machine type on the basis of said second calculation information in said second storage means corresponding to the designated machine type.

3. The knit design system as claimed in claim 2 further comprising:

retaining means for storing and retaining said design information inputted, said operation information prepared, and said control information prepared; and correction means for correcting information stored in said retaining means, wherein said correction means can serve said information corrected to said first calculation means when said information corrected is the design information, and can serve said information corrected to said second calculation means when said information corrected is the operation information.

4. The knit design system of claim 2, further comprising:

third storage means for storing image information indicating a stitch structure in a plurality of graphic patterns;

input means for inputting design information indicating a shape of a fabric to be knitted and a stitch structure;

first image processing means for forming a contour image corresponding to a shape indicated by said design information inputted;

second image processing means for preparing a stitch image by using said plurality of graphic patterns corresponding to a structure indicated by said design information inputted from said input means;

third image processing means for synthesizing said stitch image prepared and said contour image in order to prepare a fabric image; and display means for displaying the said fabric image prepared.

5. The knit design system as claimed in claim 4, wherein said second image processing means selects said graphic patterns externally instructed, and displays on said display means a fabric image by using only graphic patterns selected.

6. The knit design system as claimed in claim 4, wherein said third image processing means scales up or down said fabric image prepared.

7. The knit design system as claimed in claim 4, wherein said third image processing means prepares said stitch image for front portion and back portion of the fabric, respectively.

8. A knitting data preparation method comprising the steps of:

predetermining a first correspondence between a plurality of first characteristic parameters indicating a stitch structure and including head information, restriction information twist information, stitch length information, yarn number and link information and a plurality of second characteristic parameters indicating a knitting operation and including knitting operation information, racking information stitch transferring operation information, dropping action information, encounter setting operation information and pull-down tension setting operation and showing a common knitting procedures for knitting machines;

storing in a memory said plurality of first characteristic parameters associated with a fabric in a manner that each of said plurality of first characteristic parameters corresponds to a one of positions of stitches constituting the fabric to be knitted;

reading by using a searching processing of a calculation unit said plurality of first characteristic parameters successively along a knitting direction of a yarn, said reading being performed with regard to positions of stitches continuously formed by the same yarn in the fabric; and preparing knitting data indicating a knitting procedure of said fabric by converting said plurality of first characteristic parameters which have been read to said plurality of second characteristic parameters according to the first correspondence by using a calculation processing of the calculation unit.

9. The knitting data preparation method as claimed in claim 8 further comprising the steps of:

predetermining a second correspondence between a plurality of control parameters designating a knitting operation of a knitting machine and said plurality of second parameters;

rearranging said plurality of second characteristic parameters in a knitting sequence of said knitting machine by said calculation unit; and converting by the calculation processing of the calculation unit said plurality of second characteristic parameters which have been rearranged to said plurality of control parameters according to the second correspondence, so that second knitting data for controlling said knitting machine is prepared.

* * * * *